US009885471B2

(12) United States Patent
Dirsa et al.

(10) Patent No.: US 9,885,471 B2
(45) Date of Patent: Feb. 6, 2018

(54) MULTIPLE ELECTRONIC TAG HOLDER

(71) Applicant: KOEHLER-BRIGHT STAR LLC, Hanover Township, PA (US)

(72) Inventors: Mark Dirsa, Shavertown, PA (US); Jeff Keisling, Clarks Summit, PA (US); Robert Baran, Plains, PA (US); Joseph Bobbin, Nanticoke, PA (US); John Devaney, Mountain Top, PA (US)

(73) Assignee: KOEHLER-BRIGHT STAR LLC, Hanover Township, PA (US)

( * ) Notice: Subject to any disclaimer, the term of this patent is extended or adjusted under 35 U.S.C. 154(b) by 1282 days.

(21) Appl. No.: 13/887,512

(22) Filed: May 6, 2013

(65) Prior Publication Data

US 2013/0314904 A1 Nov. 28, 2013

Related U.S. Application Data

(63) Continuation-in-part of application No. 12/176,382, filed on Jul. 20, 2008, now abandoned.

(60) Provisional application No. 61/642,779, filed on May 4, 2012, provisional application No. 60/961,627, filed on Jul. 20, 2007.

(51) Int. Cl.

| | |
|---|---|
| ***G08B 13/14*** | (2006.01) |
| ***F21V 33/00*** | (2006.01) |
| ***A42B 3/04*** | (2006.01) |

(52) U.S. Cl.

CPC ..... *F21V 33/0064* (2013.01); *A42B 3/04* (2013.01); *A42B 3/044* (2013.01)

(58) Field of Classification Search

CPC ..... F21V 33/0064; A42B 3/04; A42B 3/044
USPC ..... 340/572.8
See application file for complete search history.

(56) References Cited

U.S. PATENT DOCUMENTS

| | | | |
|---|---|---|---|
| 1,119,663 | A | 12/1914 | Swallow |
| 1,722,869 | A | 2/1928 | Vanusek |
| 2,640,980 | A | 6/1953 | Nathan |
| 2,788,439 | A | 4/1957 | Hesse |
| 2,893,379 | A | 7/1959 | Springer |
| 2,895,137 | A | 7/1959 | Boyer et al. |
| 3,201,771 | A | 8/1965 | Proulx |

(Continued)

FOREIGN PATENT DOCUMENTS

| | | |
|---|---|---|
| BE | 1006868 | 1/1995 |
| CN | 102228319 A | 5/2011 |

(Continued)

OTHER PUBLICATIONS

Mine Site Technologies "Tracker Tagging", dated Sep. 21, 2007; www.minesuite.com/au/coal_mines_tracker_tagging, pp. 1-6.

(Continued)

*Primary Examiner* — Zhen Y Wu

(74) *Attorney, Agent, or Firm* — Levenfeld Pearlstein, LLC

(57) ABSTRACT

A multiple electronic tag holder includes a housing adapted to hold a plurality of electronic tags. Circuitry adapted to electrically engage a battery and the plurality of electronic tags, so that the plurality of electronic tags are powered by the battery, is positioned within the housing. A printed circuit board may optionally be provided and positioned within the housing to power the electronic tags and provide the multiple electronic tag holder with additional functionality.

23 Claims, 21 Drawing Sheets

(56) References Cited

U.S. PATENT DOCUMENTS 3,273,163 A 9/1966 Andrews, III
3,302,018 A 1/1967 Vincent
3,334,223 A 8/1967 Morton
3,646,339 A 2/1972 Yssel
3,750,023 A 7/1973 Weissenborm et al.
4,090,232 A 5/1978 Golden
4,092,704 A 5/1978 Malm
4,156,942 A 6/1979 Isfeld
4,199,802 A * 4/1980 Malm ..... A42B 3/044 362/105
4,238,709 A 12/1980 Wallace
4,263,588 A 4/1981 Gautier
4,276,657 A 7/1981 Montesi
4,298,913 A 11/1981 Lozar
4,491,971 A 1/1985 Webb et al.
4,495,550 A 1/1985 Visciano
4,530,112 A 7/1985 Cecala et al.
4,533,984 A 8/1985 Gatton
D287,644 S 1/1987 Gierke
4,793,007 A 12/1988 Barnett
5,463,538 A 10/1995 Womack
5,541,822 A 7/1996 Bamber
5,697,099 A 12/1997 Siska et al.
5,800,042 A 9/1998 Blank
D448,099 S 9/2001 Mariani
6,497,493 B1 12/2002 Theisen
6,507,280 B2 * 1/2003 Tabata ..... A42B 3/303 2/6.2
6,575,587 B2 * 6/2003 Cramer ..... F21L 14/00 362/105
6,618,906 B2 9/2003 Ciesiun
6,730,047 B2 5/2004 Socci et al.
6,817,730 B2 11/2004 Sharrah et al.
6,853,303 B2 2/2005 Chen et al.
6,877,875 B2 * 4/2005 Yu ..... A42B 3/044 362/105
7,048,403 B2 5/2006 Parker et al.
7,076,441 B2 7/2006 Hind et al.
7,147,338 B2 12/2006 Gregg
7,314,286 B2 1/2008 Sharrah et al.
2002/0036569 A1 * 3/2002 Martin ..... A01K 11/008 340/573.1
2002/0089304 A1 7/2002 Lew
2003/0071766 A1 4/2003 Hartwell et al.
2003/0102974 A1 6/2003 Allen
2003/0137421 A1 * 7/2003 Herkenrath ..... E21F 17/18 340/573.1
2004/0008157 A1 1/2004 Brubaker et al.
2004/0174269 A1 9/2004 Miller et al.
2004/0249557 A1 * 12/2004 Harrington ..... G01M 17/007 701/115
2004/0261159 A1 * 12/2004 Reilly ..... A42B 3/0406 2/422
2005/0010992 A1 * 1/2005 Klotz ..... A41D 13/1153 2/171.3
2005/0114154 A1 5/2005 Wolkowicz et al.
2005/0170828 A1 8/2005 Nakamura et al.
2005/0248459 A1 11/2005 Bonalle et al.
2006/0044112 A1 3/2006 Bridgelall
2006/0077253 A1 4/2006 VanRiper et al.
2006/0104043 A1 * 5/2006 Golle ..... A41D 13/01 362/84
2006/0118109 A1 * 6/2006 Sato ..... B63C 11/06 128/201.27
2006/0125623 A1 6/2006 Appelt et al.
2006/0143645 A1 * 6/2006 Vock ..... A43B 3/00 725/9
2006/0195261 A1 * 8/2006 Riley ..... G06F 1/1626 701/469
2006/0198122 A1 9/2006 Senter et al.
2006/0215393 A1 9/2006 VanderSchuit
2006/0220880 A1 * 10/2006 Yasur ..... G08B 13/1445 340/573.1
2006/0272189 A1 12/2006 Cummings et al.
2006/0273894 A1 12/2006 Goehler
2006/0282939 A1 12/2006 Rogers et al.
2007/0035626 A1 2/2007 Randall et al.
2007/0081293 A1 * 4/2007 Brundula ..... F41H 13/0018 361/232
2007/0096930 A1 5/2007 Cardoso
2007/0097668 A1 * 5/2007 Choi ..... A42B 3/044 362/105
2007/0109768 A1 5/2007 Sohn
2007/0126579 A1 6/2007 Adams et al.
2007/0135243 A1 * 6/2007 LaRue ..... A63B 24/0021 473/467
2007/0159332 A1 7/2007 Koblasz
2007/0159809 A1 * 7/2007 Kim ..... A42B 3/044 362/103
2007/0159810 A1 7/2007 Kim
2007/0186330 A1 8/2007 Howell et al.
2007/0188331 A1 8/2007 Kumagai et al.
2007/0208542 A1 9/2007 Vock et al.
2007/0214551 A1 9/2007 Teetzel et al.
2007/0271686 A1 * 11/2007 Rast ..... A42B 3/328 2/410
2008/0030345 A1 * 2/2008 Austin ..... A61B 90/90 340/572.8
2008/0055888 A1 3/2008 Sharrah et al.
2008/0130272 A1 * 6/2008 Waters ..... G02C 11/04 362/106
2008/0137589 A1 6/2008 Barrett
2009/0000965 A1 * 1/2009 Arbel ..... A45C 11/18 206/38
2009/0038056 A1 2/2009 Bobbin et al.
2009/0059159 A1 * 3/2009 Howell ..... G02C 11/00 351/41
2009/0073679 A1 3/2009 Wainright
2009/0174547 A1 7/2009 Greene et al.

FOREIGN PATENT DOCUMENTS

DE 3321790 1/1985
EP 0 066 472 6/1982
EP 66472 12/1982
EP 0 291 438 5/1988
EP 553037 7/1993
EP 5530374 7/1993
GB 2407935 5/2005
KR 2006123918 5/2006
KR 2006101405 9/2006
MX 2008000589 A 1/2008
MX 2009000419 A 1/2009
MX 2008009351 A 3/2009
SU 1777789 11/1992
WO WO 20061036725 4/2006
WO 2006053185 A2 5/2006
WO WO 2007/000686 1/2007

OTHER PUBLICATIONS

European Search Report, Application No. EP 08 25 2472, dated Jan. 27, 2010.
"Underground Mine Rescue Equipthent and Technology" document, dated Mar. 24, 2008.
"New Tracking System Really-Proven Out" article, dated Apr. 1, 2007.

* cited by examiner

MULTIPLE ELECTRONIC TAG HOLDER

CLAIM OF PRIORITY

This application claims priority to U.S. Provisional Patent Application Ser. No. 61/642,779, filed May 4, 2012, and is a continuation-in-part of U.S. patent application Ser. No. 12/176,832, filed Jul. 20, 2008, which claims priority to U.S. Provisional Patent Application Ser. No. 60/961,627, filed Jul. 20, 2007.

FIELD OF THE INVENTION

The present invention relates generally to accessories for battery packs used to power cap lamps and other electronic devices and, in particular, to a multiple electronic tag holder that receives and powers multiple personal safety device tags in addition to or separately from a cap lamp.

BACKGROUND

Different types of protective headgear, such as helmets and hard hats, are typically worn by fire fighters, rescue personnel and in industries where protection of the head from falling debris or the like is necessary. Such industries include, but are not limited to construction and mining.

Oftentimes it is desirable to attach electronic modules, such as radio frequency identification (RFID) tags, global positioning system (GPS) tags, and natural gas sensor tags to protective headgear. For example, modern day mines often include a miner tracking system so that the location of miners may be tracked for safety purposes. Such systems often include sensors positioned throughout the mine shafts. A miner wears an RFID tag which broadcasts a signal including the identity of the miner wearing the RFID tag. When the miner passes a miner tracking system sensor, the sensor receives the signal from the RFID tag. The sensors communicate with a central computer which tracks the location of miners wearing the RFID tags based on which sensors have received signals from the miners' RFID tags.

Like the other types of electronic modules, RFID tags must receive electrical power to operate. Mining cap lamps are typically mounted on helmets worm by miners to provide illumination in underground mine shafts. Such cap lamps are well known in the mining equipment industry and provide illumination while the miner's hands remain free to perform tasks. A cap lamp typically receives power from a battery power pack secured to the user's waist. Electrical wiring, delivers power from the power pack to the lamp on the helmet. Traditionally, wires have been soldered to the battery terminals of the cap lamp power pack and to the RFID tags so that the RFID tags receive power from the battery of the cap lamp power pack. A problem with such an arrangement, however, is that such modifications are time consuming and inconvenient. In addition, and more importantly, the quality of the soldered connections is often inconsistent which leads to reliability issues, especially in the harsh mining environment. The exposed wires of such a power takeoff are also exposed which makes them even more vulnerable to damage.

Cordless cap lamps, where the battery pack and cap lamp are integrated into a single unit that is worn on the cap, are also known.

The Mine Improvement and New Emergency Response Act of 2006 requires mines to implement personal tracking, communication, and emergency plans. When individuals are working in hazardous locations such as a mine, emergency prevention and preparedness is a key element in the survival of those individuals. Prevention is the first line of defense (personal atmospheric monitoring and proximity), however, in the event of an emergency, response time is critical to survival. Response time is significantly influenced by the ability to locate each individual in an emergency situation. Tracking tags are key to locating the individuals rapidly.

As regulations continue to drive the need for atmospheric monitoring, tracking and proximity devices, employers will need to deploy the technologies and devices to their workforce. The current devices that an individual may wear are typically singular, self-contained cap lamp systems or units. In view of the above, individuals may be required to carry multiple tag devices that perform different functions in addition to the single self-contained cap lamp unit or system. Each tag device typically has its own self-contained power source. Such an arrangement suffers from a number of disadvantages. For example, self-contained tag devices typically have a power source that is smaller than a cap lamp battery and thus more limited in capacity. In addition, it is difficult to manage the maintenance of individual batteries for each one of the individual tag devices. A number of self-contained devices also increases difficulty of use.

A need therefore exists for a system and method that integrates tag devices and allows for individual and multiple tags to be contained and powered from a single power source.

DETAILED DESCRIPTION OF EMBODIMENTS

As explained in greater detail below, the invention may be used with radio frequency identification (RFID) tags and other types of electronic modules including, but not limited to, global positioning system (GPS) tags, and natural gas sensor tags.

Figure 1:
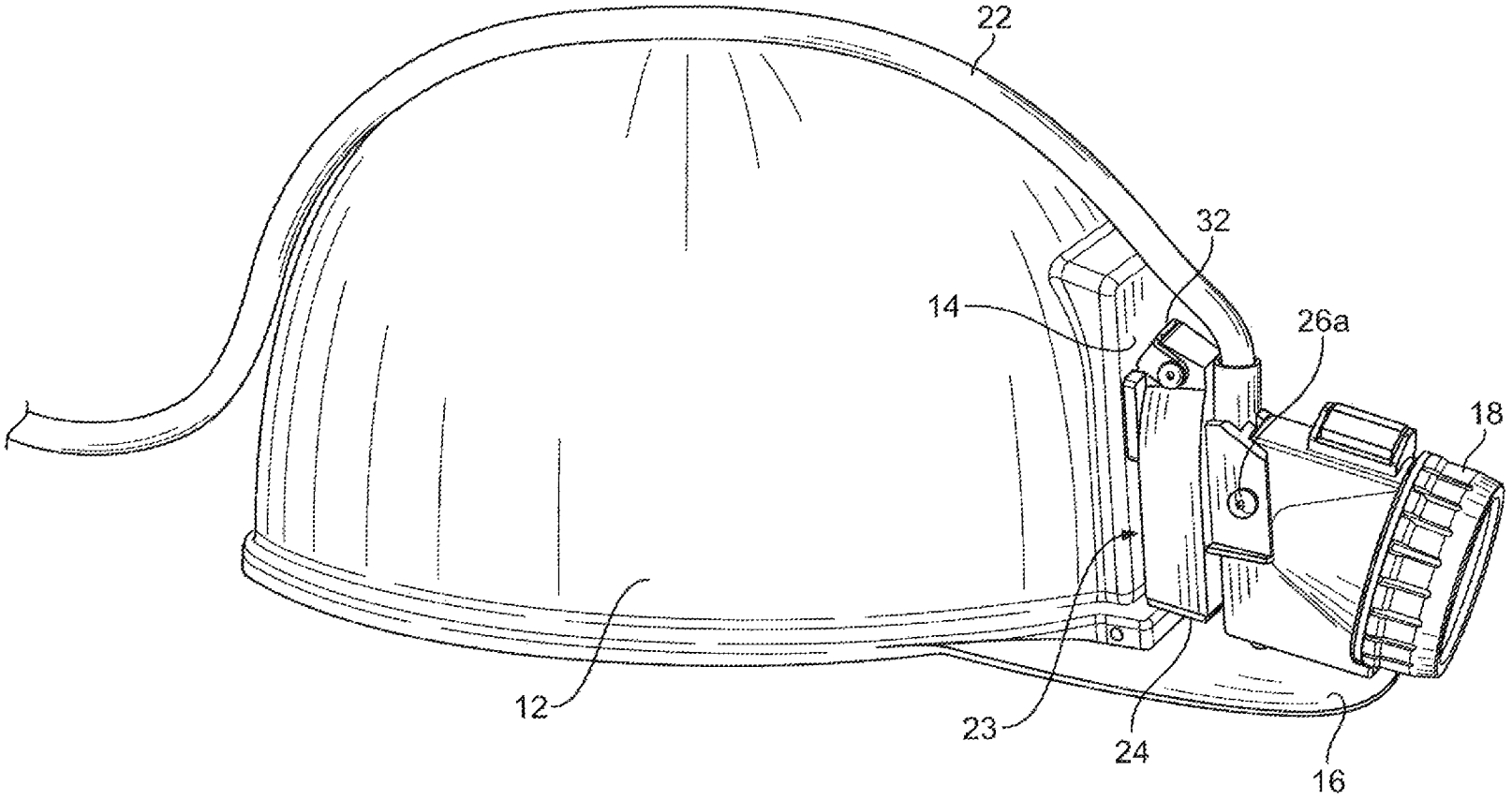
FIG. 1 is a perspective view of a helmet with a cap lamp secured thereto by an embodiment of an electronic module adapter.
Figure 2:
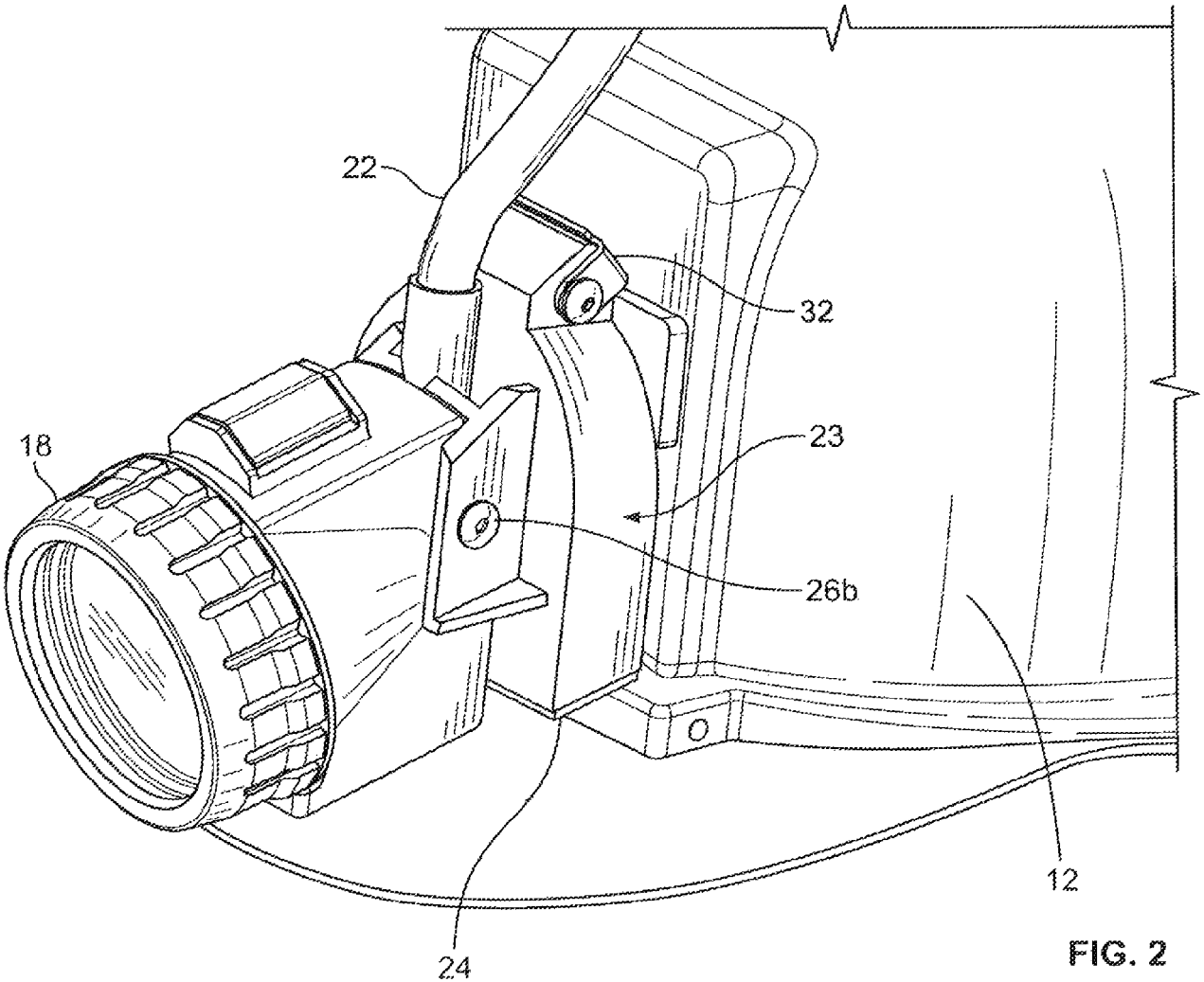
FIG. 2 is an enlarged perspective view of the front portion of the helmet, the cap lamp and the electronic module adapter of FIG. 1.
Figure 3:
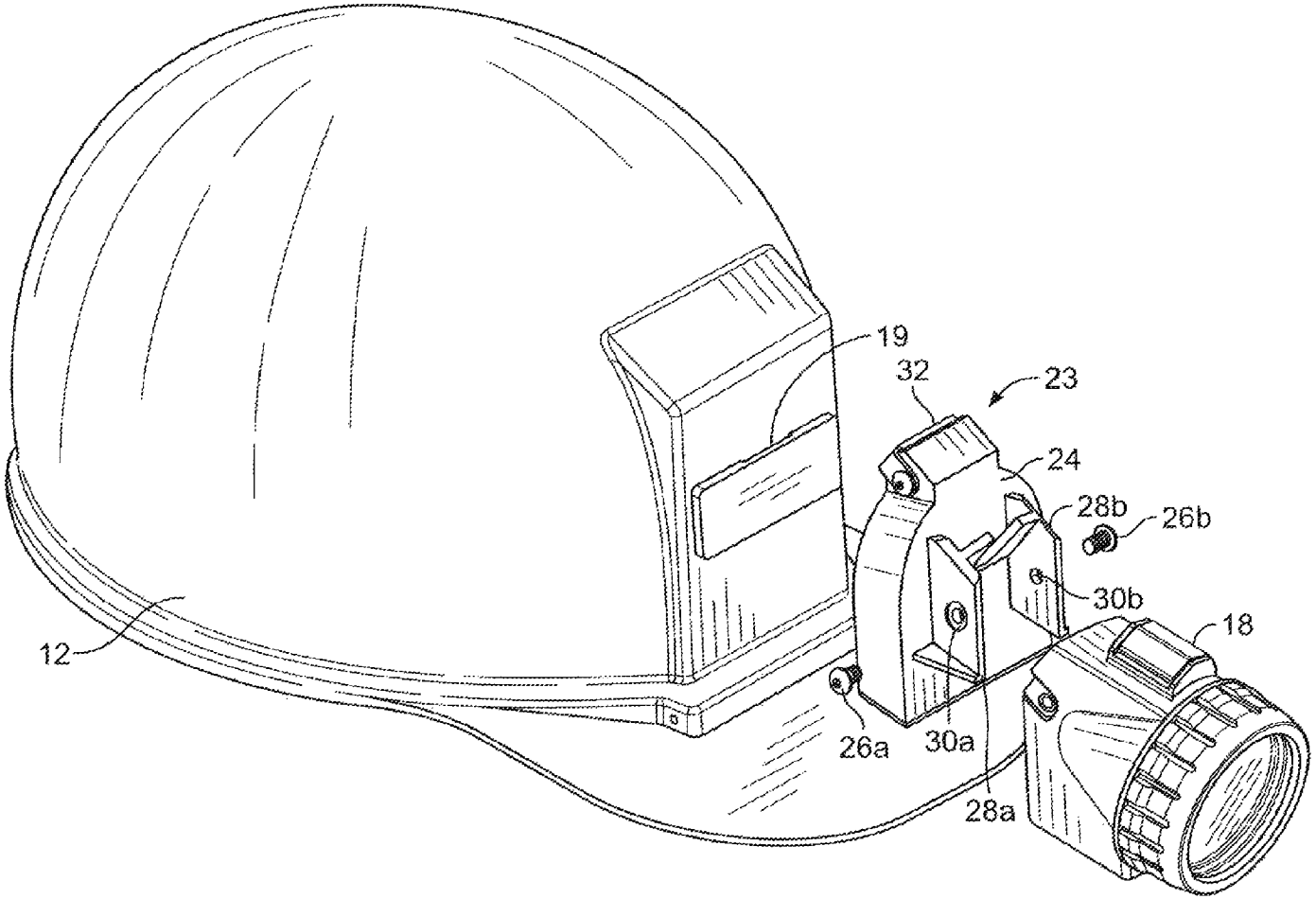
FIGS. 3 and 4 are perspective exploded views of the helmet, cap lamp and electronic module adapter of FIGS. 1 and 2.
Figure 4:
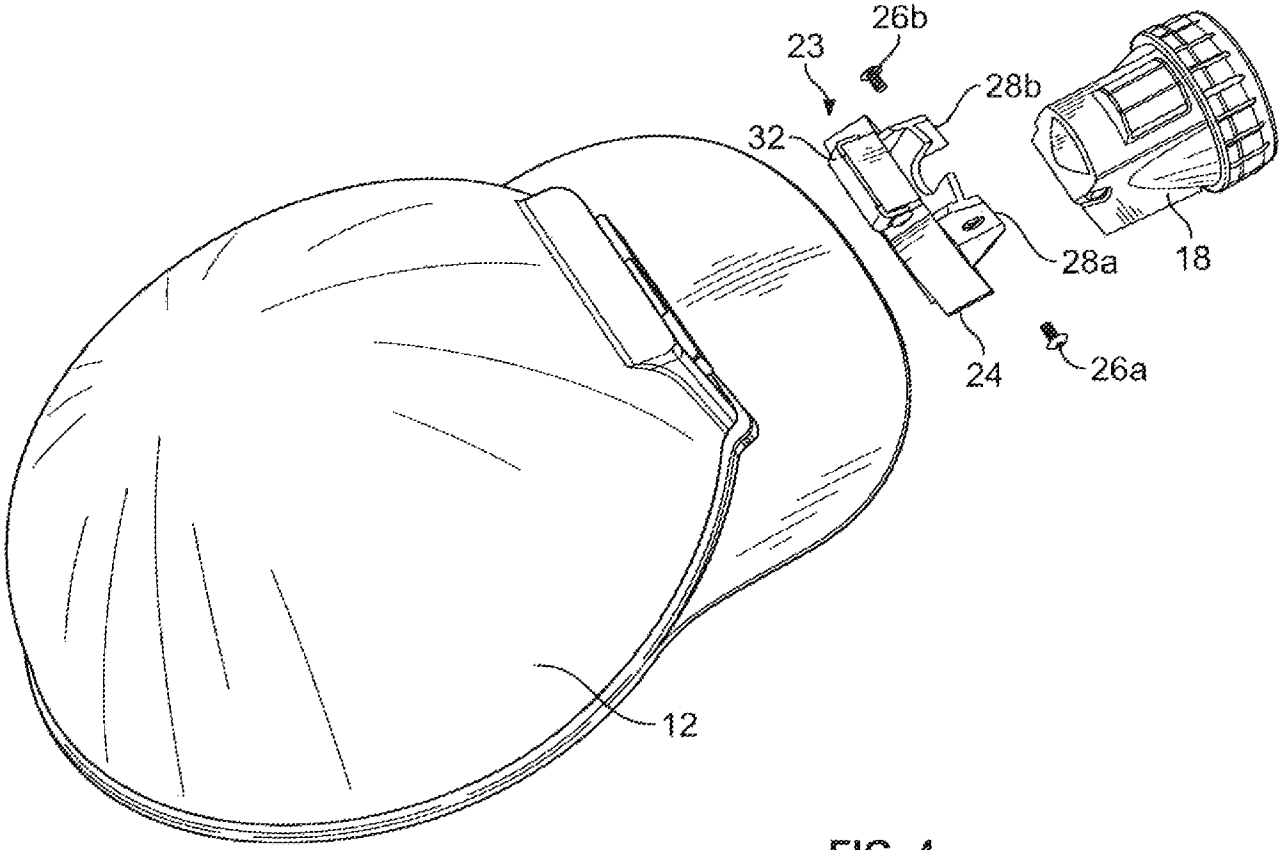

A helmet, such as used in mining, is indicated at 12 in FIGS. 1-4. As illustrated in FIG. 1, the helmet includes a front panel 14 and a visor 16. A cap lamp is indicated at 18 in FIGS. 1-4. As an example only, the cap lamp may be a model LI-16 cap lamp sold by Koehler-Bright Star, Inc, of Hanover Township, Pa. As is known in the art, the cap lamp receives power via a power cord, indicated at 22 in FIGS. 1 and 2, from a battery pack (not shown) typically worn strapped to the waist of the miner or in another location. The cap lamp 18 is typically mounted to the front panel 14 of the helmet by a clip positioned on the back side of the cap lamp. This clip typically engages a slot, such as the one indicated at 19 in FIG. 3. As a result, the cap lamp may be removed from the helmet for recharging or servicing.

The helmet clip normally used to mount the cap lamp to the helmet is removed from the cap lamp. An electronic module adapter, indicated in general at 23 in FIGS. 1-7, includes a housing 24 that, as explained in greater detail below, defines a chamber which houses electronic module circuitry and batteries. For example, the electronic module circuitry may be a self powered RFID tag (printed circuit board with three coin cell batteries). Alternatively, the electronic module adapter may act as a mounting point (like a docking station) or power source, with batteries present in the electronic module adapter, for a variety of interchangeable electronic devices. Instead of batteries, the electronic module adapter may receive power from the power cord 22 (FIG. 1).

As indicated in FIGS. 1-4, the electronic module adapter housing 24 mounts to the cap lamp with two screws 26*a* and 26*b* via a cap lamp mounting bracket. The cap lamp mounting bracket features a pair of flanges 28*a* and 28*b* (FIGS. 3-5 and 7) formed on the front side of the housing. The flanges 28*a* and 28*b* include mounting holes, indicated at 30*a* and 30*b* in FIGS. 3 and 7, through which the screws 26*a* and 26*b* pass. The cap lamp mounting bracket may feature an alternative arrangement, such as a clip that engages the cap lamp or a recess that receives a clip mounted on the cap lamp.

Figure 8:
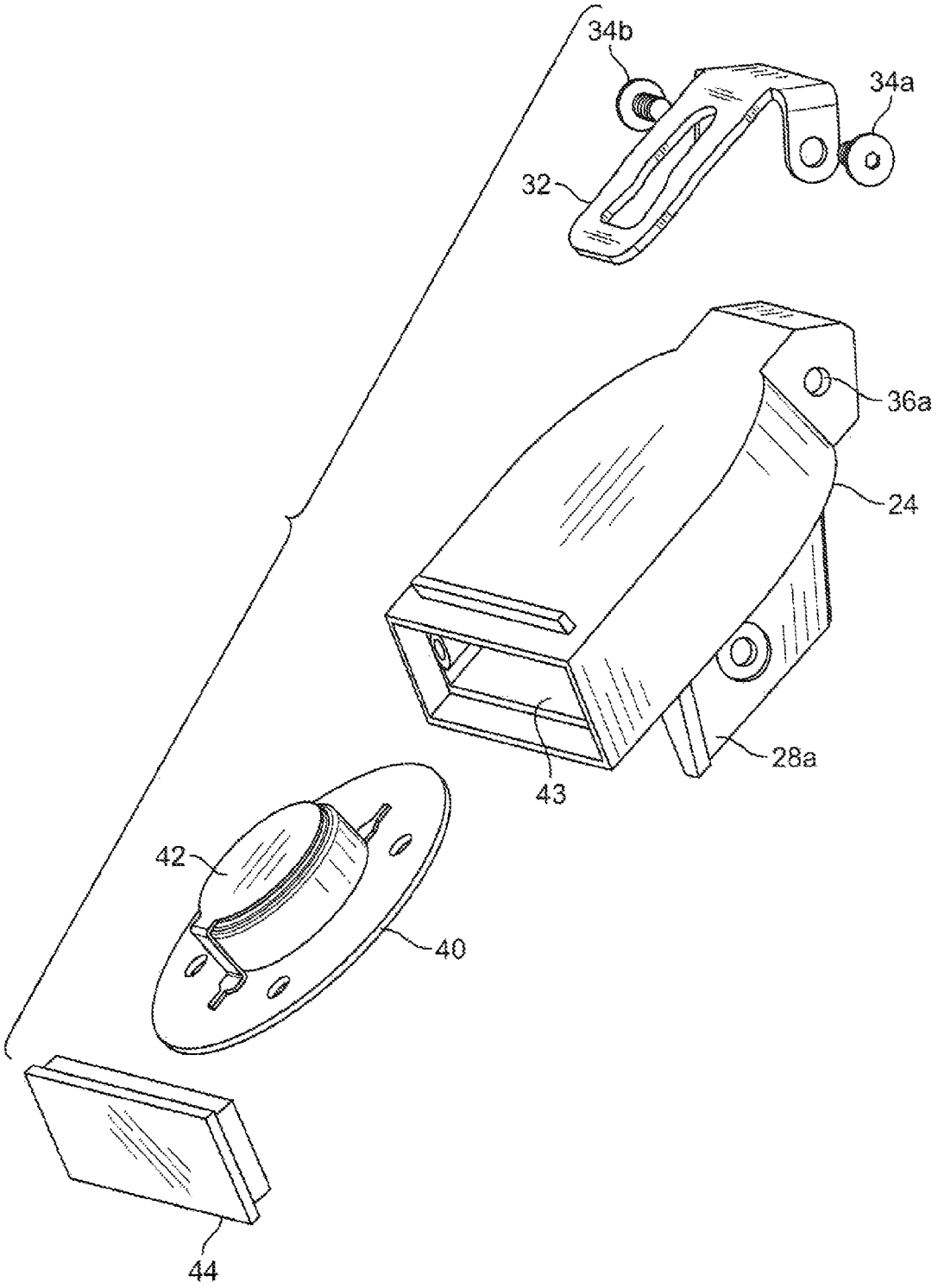
FIG. 8 is an exploded top perspective view of the electronic module adapter of FIG. 7.

As illustrated in FIGS. 5-8, a headgear mounting bracket in the form of helmet clip 32, is attached to the back side of the electronic, module adapter housing 24. More specifically, as illustrated in FIG. 8, the clip 32, which in the illustrated embodiment is made of metal, is secured to the housing via screws 34*a* and 34*b*, which engage openings 36*a* and 36*b* (not shown) formed in the housing 24. Alternatively, the clip 32 may be formed of plastic and either attached to or integrally molded with the housing 24. The housing 24 may also be constructed of metal with the clip 32 attached to it or integrally formed with the housing.

As illustrated in FIGS. 1-4, the helmet clip 32 (headgear mounting bracket) of the electronic module adapter 23 attaches to the front panel 14 of the helmet 12 and takes the place of the original cap lamp helmet clip. As a result, the helmet clip of the electronic module adapter is used to mount the whole assembly (including the electronic module adapter and cap lamp) to the helmet. The headgear mounting bracket may take a variety of alternative forms as long as it engages the helmet so as to secure the electronic module adapter housing thereto.

Figure 5:
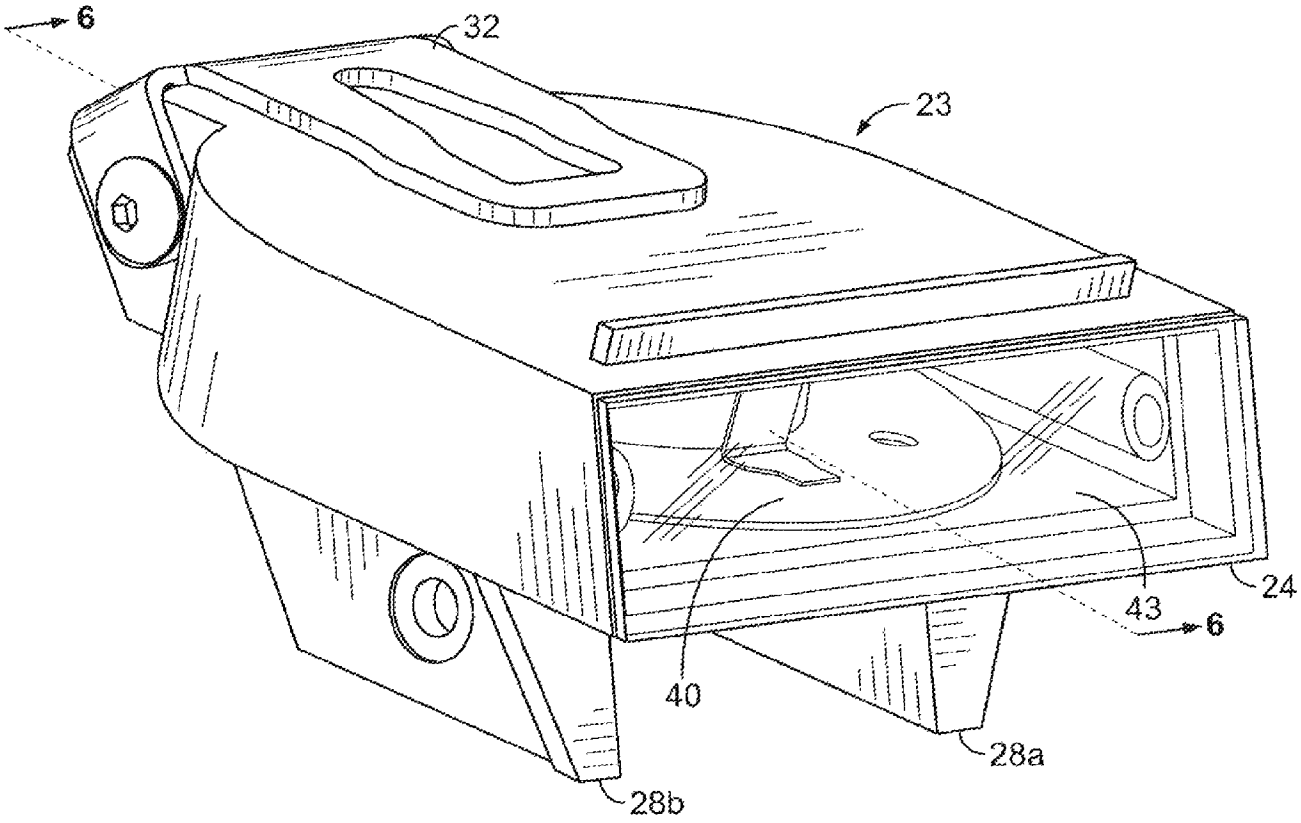
FIG. 5 is an enlarged bottom and back perspective view of the electronic module adapter of FIGS. 1-4 with the housing lid removed.
Figure 6:
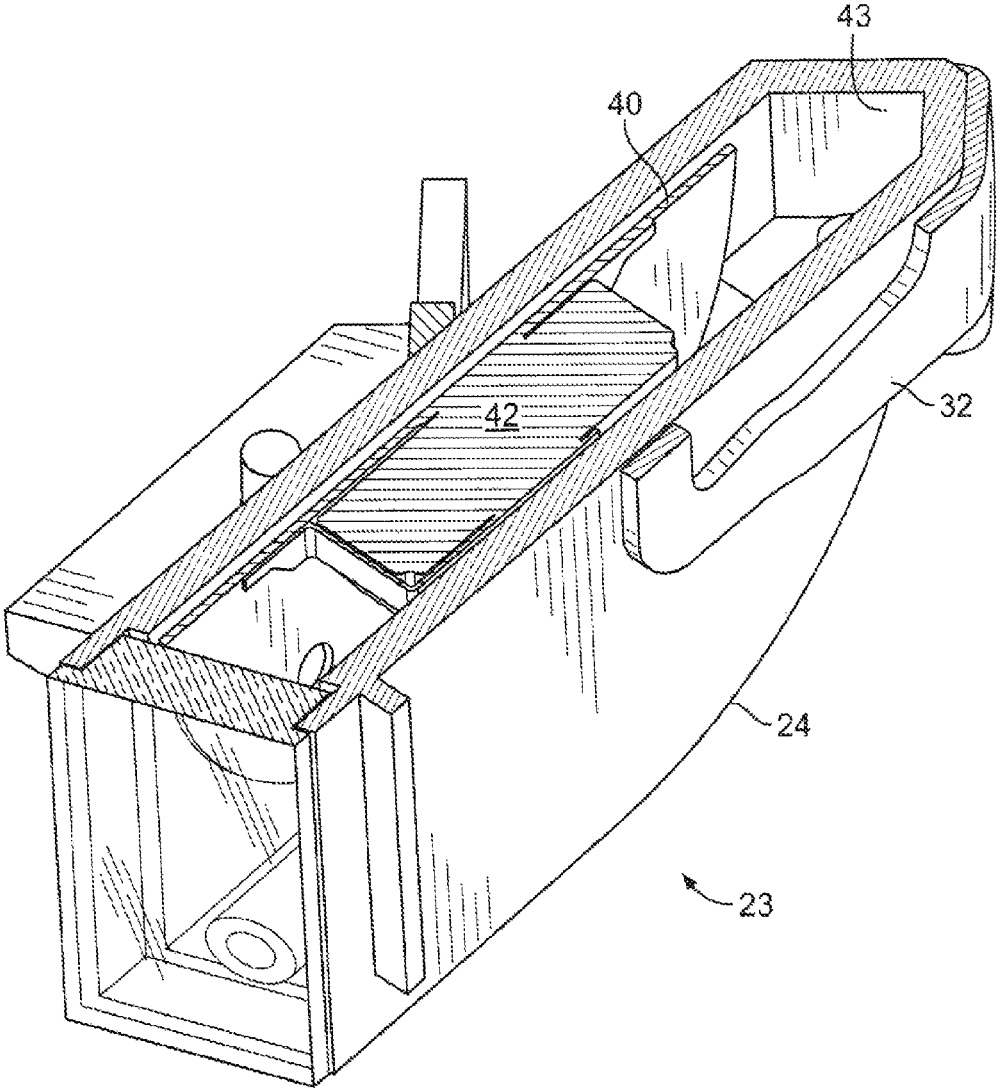
FIG. 6 is a cross-sectional view of the electronic module adapter of FIG. 5 taken along line 6-6 of FIG. 5.
Figure 7:
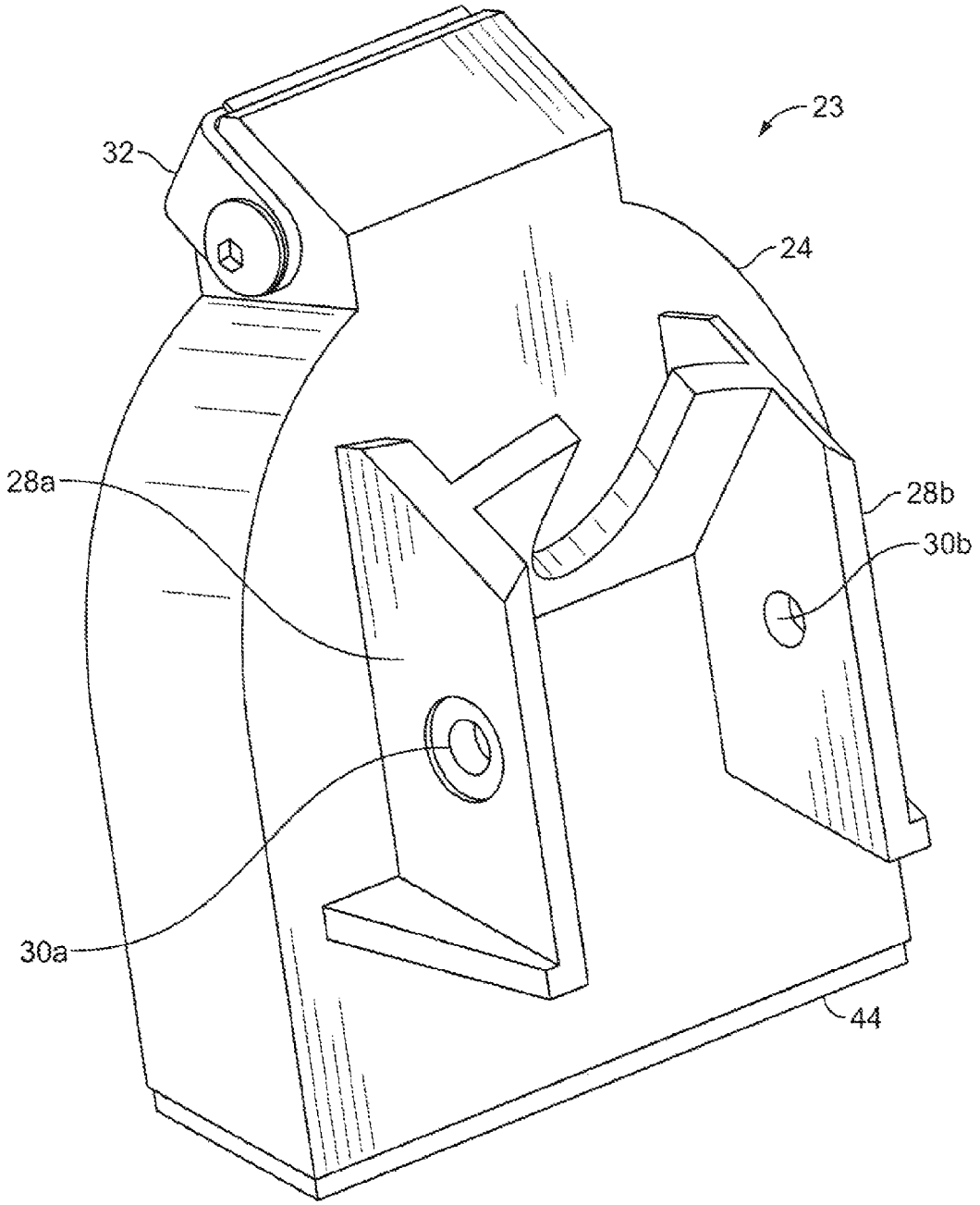
FIG. 7 is a top and front perspective view of the electronic module adapter of FIG. 5 with the housing lid attached.

As illustrated in FIGS. 5, 6 and 8, electronic module circuitry in the form of a circular circuit board 40 has mounted thereon a stark of battery coin cells 42, which provide power to the circuit board 40. The electronic module circuitry circuit board may be for a variety of electronic functions, including, but not limited to, an RFID tag, a UPS tag and/or a natural gas sensor. As illustrated in FIGS. 5, 6 and 8, the circuit board and batteries are inserted into the chamber 43 defined by the electronic module adapter housing 24 and the bottom is closed with bottom lid 44 (FIGS. 7 and 8), which may be sealed to keep dust and dirt out of the interior of the electronic module adapter. As noted previously, the batteries 42 may be omitted if the circuit board instead receives power from the cap lamp power cord 22 (FIG. 1).

The circuit board and batteries may be secured within the chamber 43 by adhesive, screws or other fastening arrangements known in the art. The bottom lid 44 may be attached to the housing 24 by adhesive, screws or other fastening arrangements known in the art.

Figure 9:
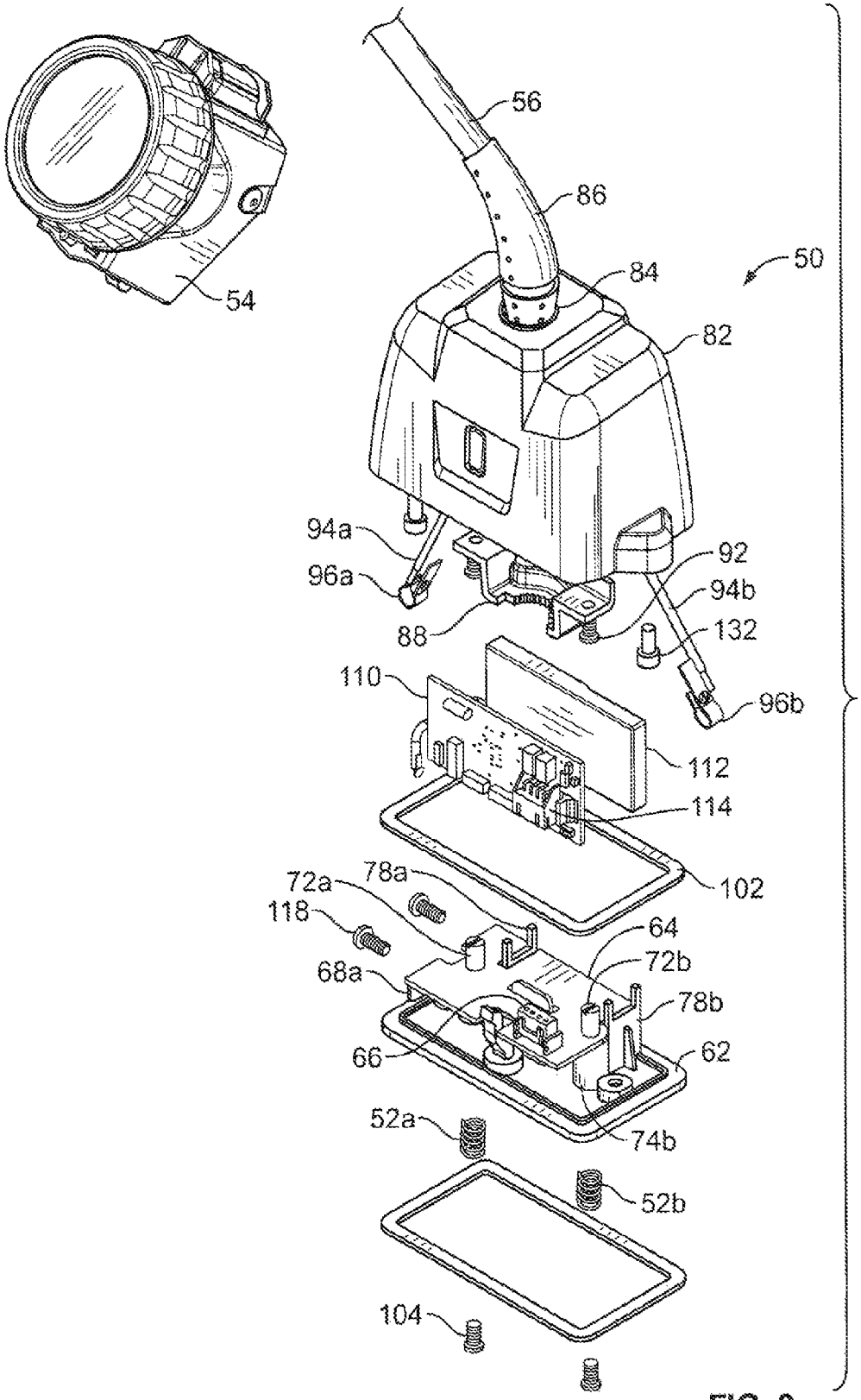
FIG. 9 is an exploded top perspective view of a first embodiment of the multiple electronic tag holder of the present invention and a cap lamp.
Figure 10:
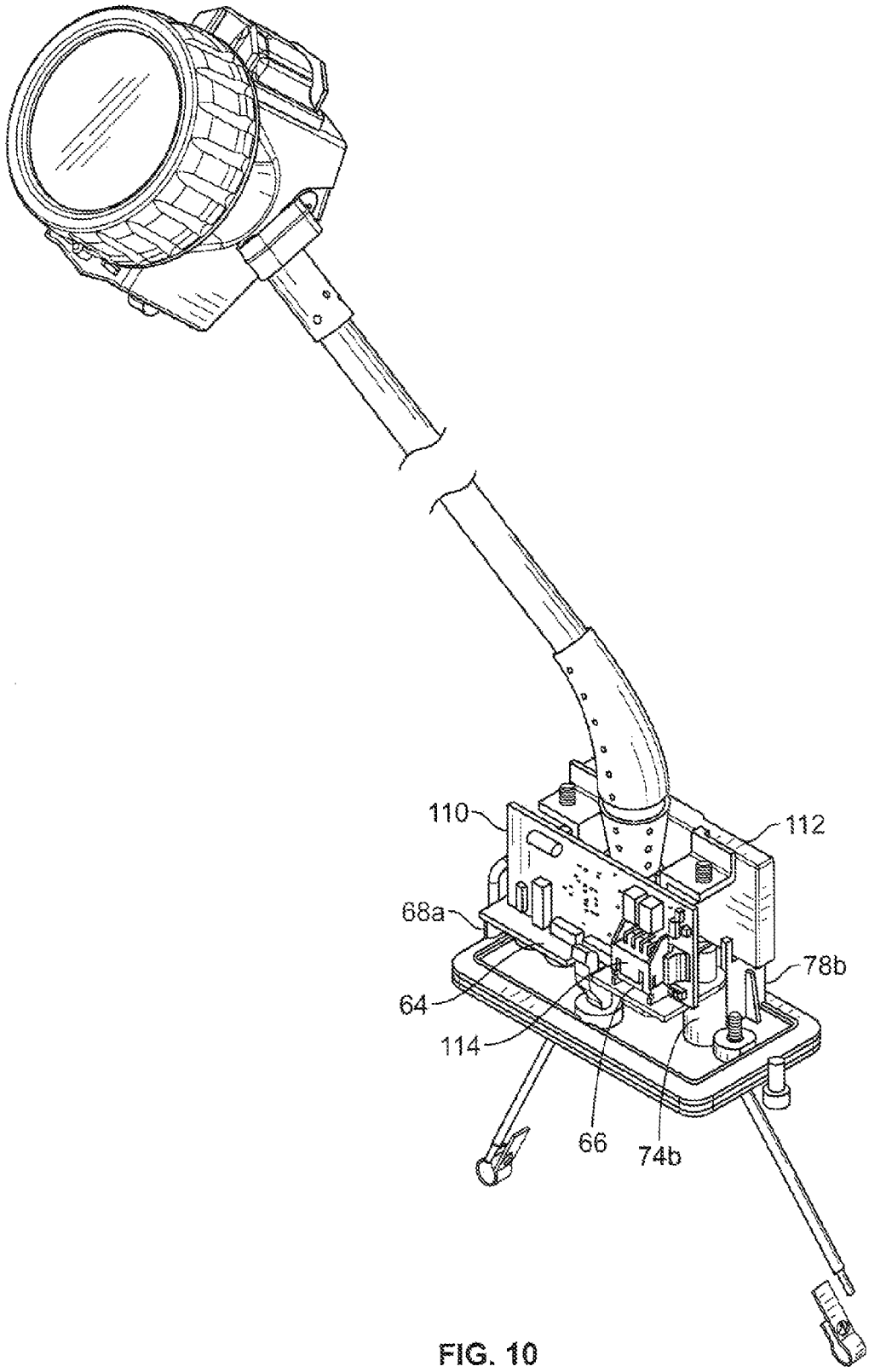
FIG. 10 is an assembled top perspective view of the multiple electronic tag holder and cap lamp of FIG. 9 with the cover omitted for clarity.
Figure 11:
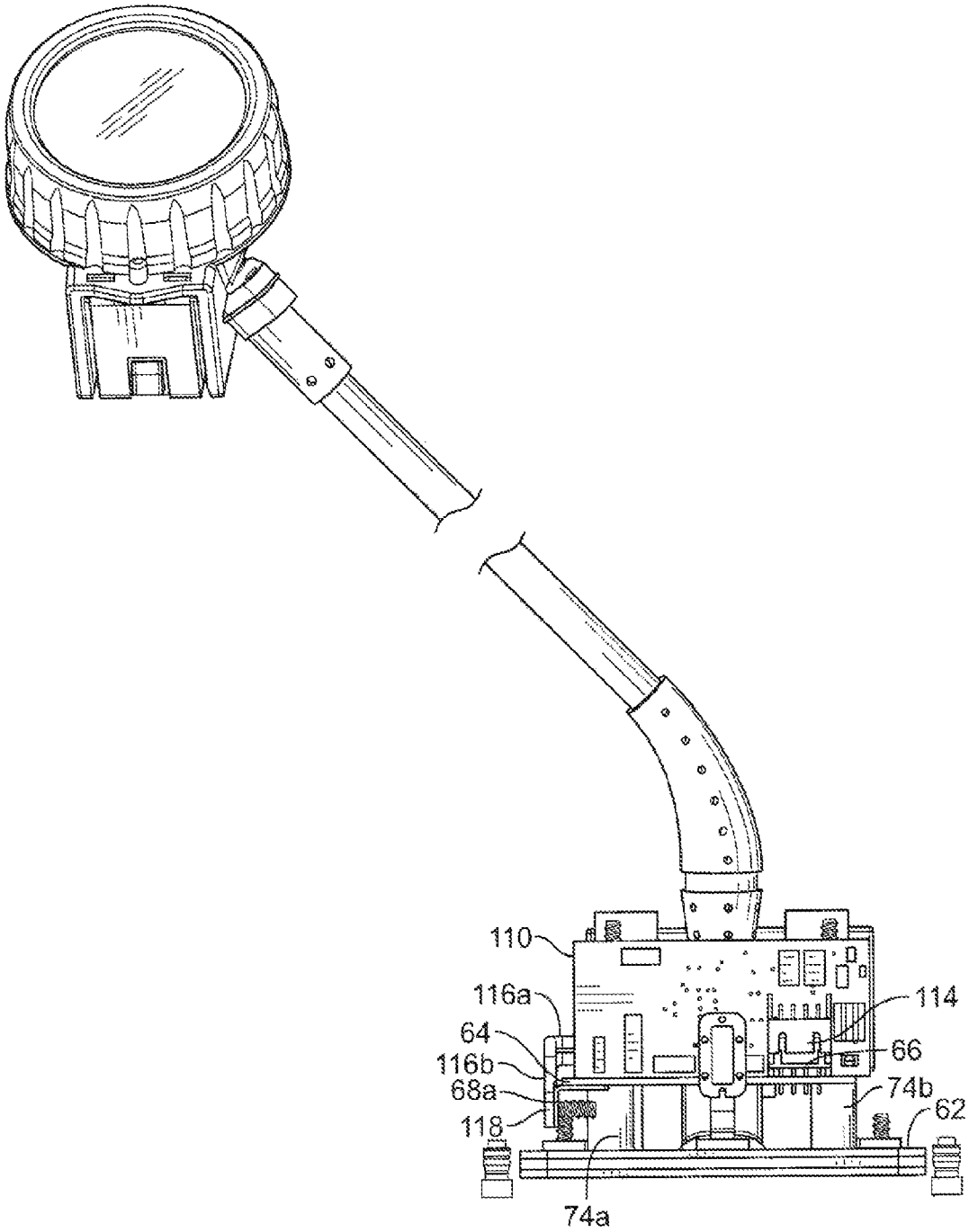
FIG. 11 is an enlarged side elevational view of the multiple electronic tag holder of FIG. 10.

A first embodiment of the multiple electronic tag holder of the present invention is indicated in general at 50 in FIG. 9. The tag holder 50 of FIG. 9 receives power from a battery or battery pack via springs 52*a* and 52*b*, as explained below. Power is provided to a cap lamp 54 via a power cord 56 (i.e. power cord 56 is connected to cap lamp 54). The battery may be any type of battery known in the prior art, but is preferably a lithium-ion battery.

Figure 12:
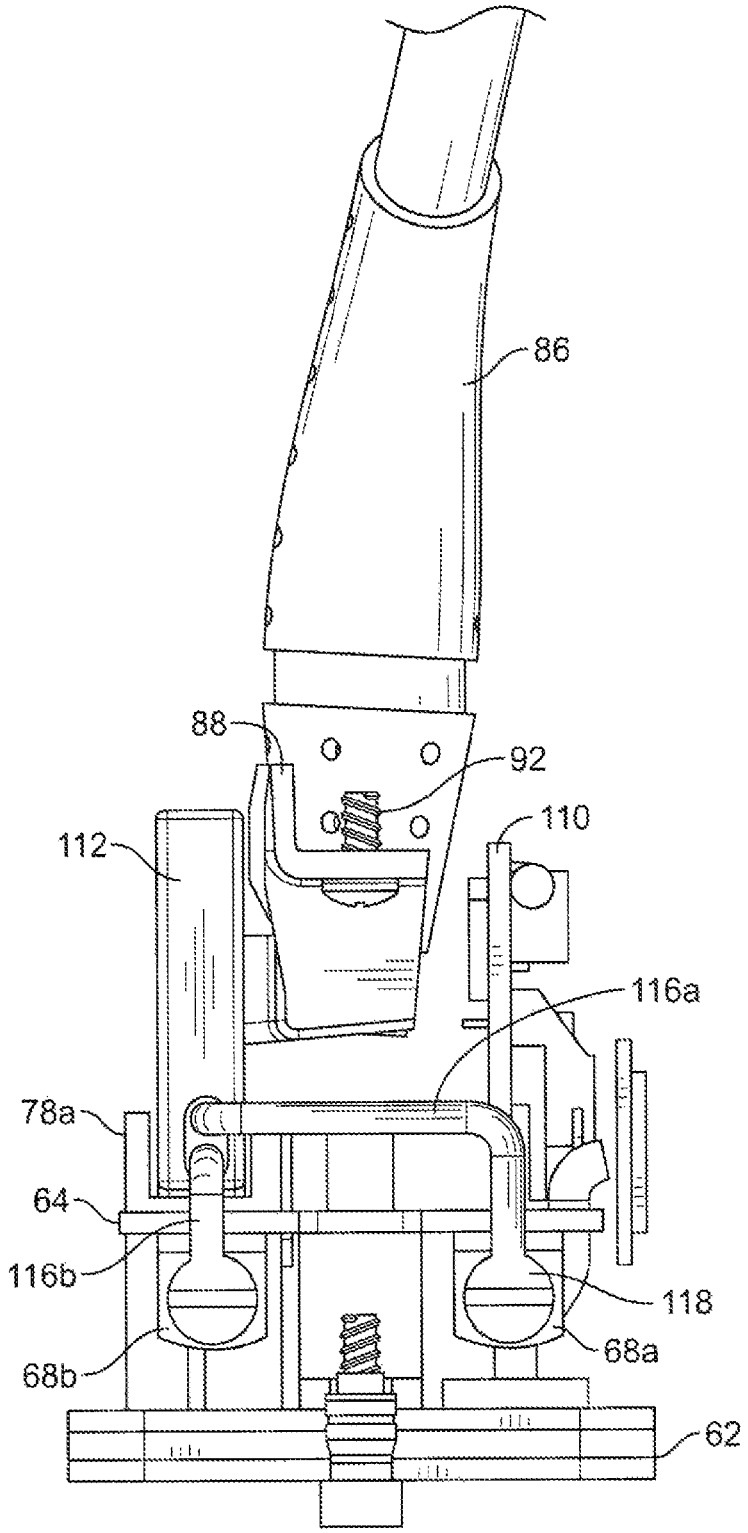
FIG. 12 is an end elevational view of the multiple electronic tag holder of FIG. 11.
Figure 19:
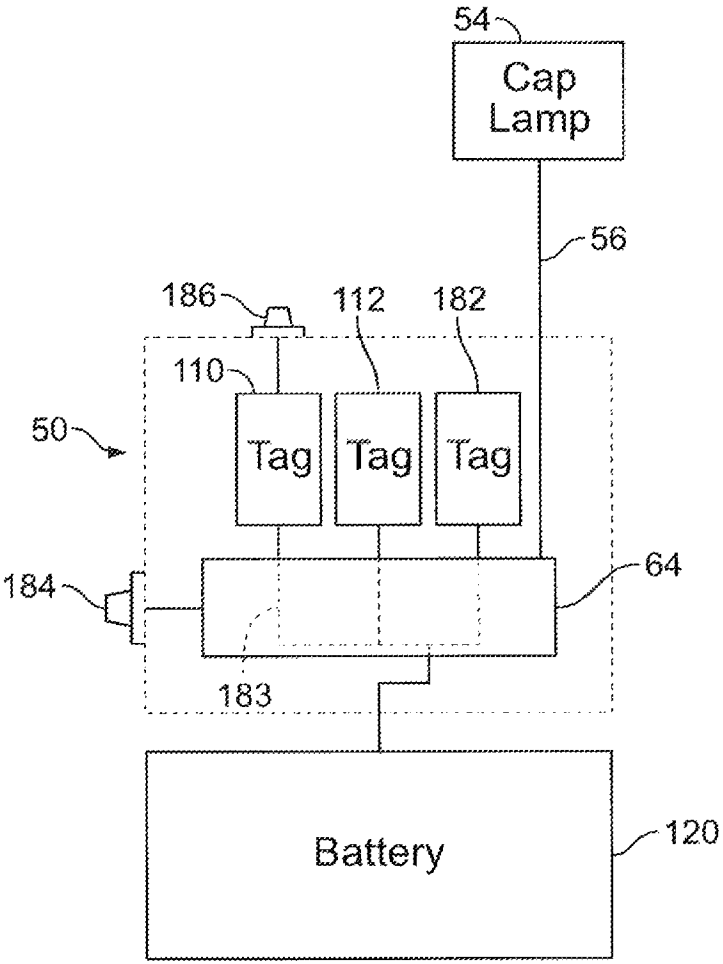
FIG. 19 is a schematic of the multiple electronic tag holder of FIGS. 9-16 and a battery pack.

As illustrated in FIGS. 19-12, the tag holder 50 includes base plate 62, upon which is mounted a printed circuit board (PCB) 64. Base plate 62 is preferably molded from plastic. The PCB 64 includes a socket 66 as well as tag power terminals 68*a* and 68*b* (best shown in FIG. 12). A pair of conductive terminal extenders 72*a* and 72*b* are connected to the PCB and pass through the tops of terminal extender columns 74*a* and 74*b*.

Figure 14:
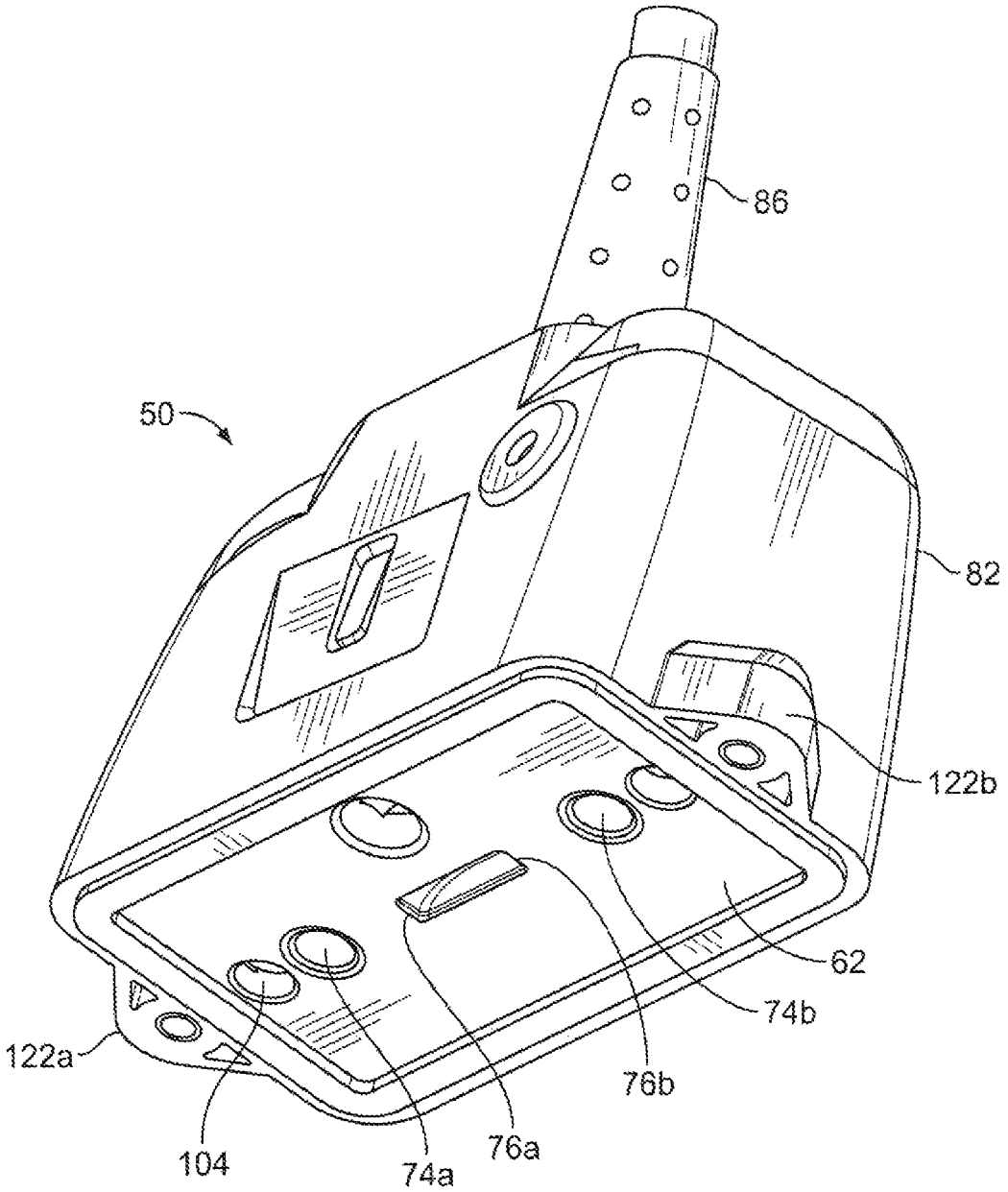
FIG. 14 is an assembled enlarged bottom perspective view of the multiple electronic tag holder of FIG. 9.

The terminal extender columns are preferably molded into the base plate 62. As illustrated in FIG. 14, the terminal extender columns are hollow and are provided with conductive inserts 76*a* and 76*b* that are in electronic communication with terminal extenders 72*a* and 72*b*, respectively. A pair of tag cradles 78*a* and 78*b* are also molded into the base plate 62.

Power may be distributed to tags positioned in the holder by the socket 66, tag power terminals 68*a* and 68*b* or terminal extenders 72*a* and 72*b*.

Figure 13:
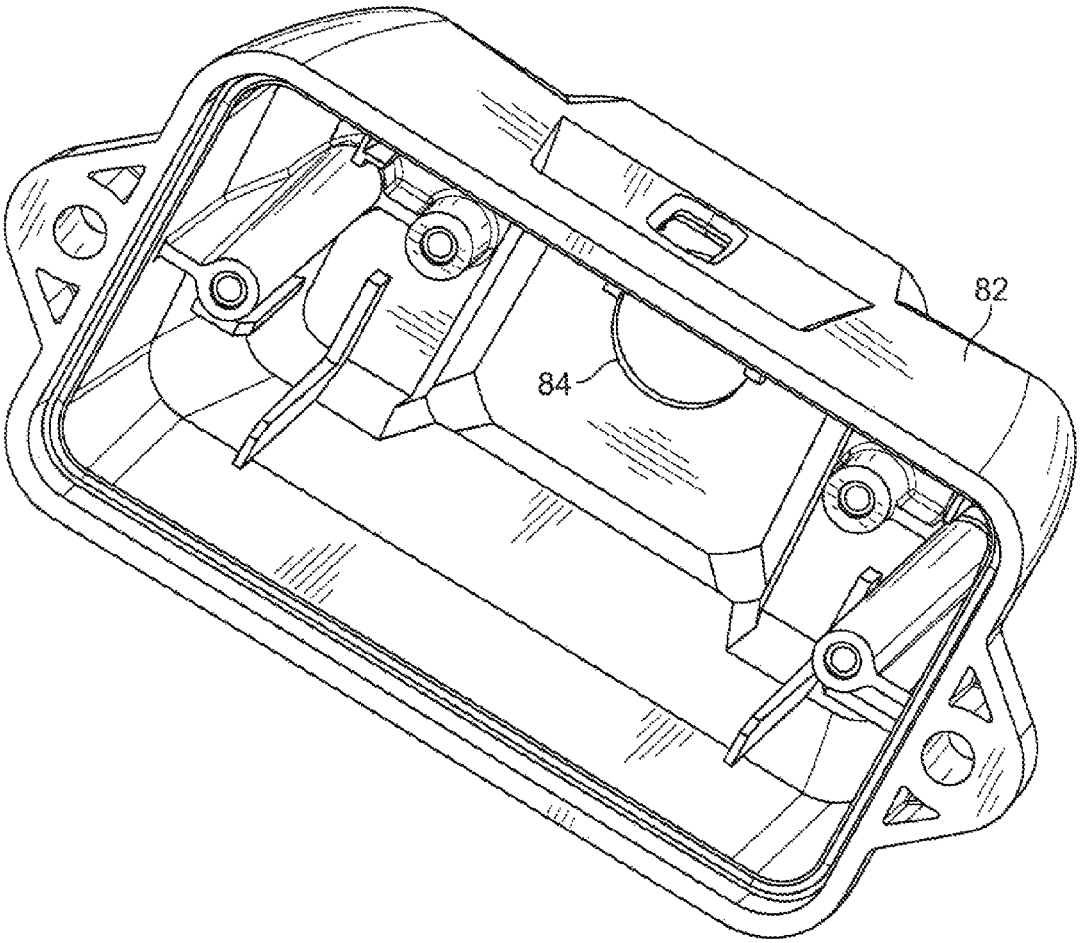
FIG. 13 is an enlarged bottom perspective view of the cover of the multiple electronic tag holder of FIG. 9.

As illustrated in FIGS. 9 and 13, a cover 82 is provided with a top opening 84 through which a cord strain 86 passes. The cord strain is secured in place on the cover 82 via a strain bracket 88 which is secured to the inner top surface of the cover by screws 92 (FIG. 12).

The cover 82 and base plate 62 form the housing of the tag holder 50.

Cord 56, which powers the cap lamp 54, is attached to the cord strain 86 and a pair of wires 94*a* and 94*b* emerge from the end of the cord 56 that opens within/under the cover. The cords are provided with clips 96*a* and 96*b* that are sized to engage and be installed to the terminal extenders 72*a* and 72*b*. As explained, below, current from a battery or battery pack flows through the terminal extenders, clips 96*a* and 96*b* and then thorough wires 94*a* and 94*b* of the cord 56 so that the cap lamp 54 is powered.

With reference to FIG. 9, an upper seal ring 102 is positioned between the cover 82 and the base plate 62 when the cover and base plate are assembled together (as illustrated in FIG. 14) to keep contaminants such as dust and moisture out of the tag holder. Screws 104 secure the base plate to the cover.

The tag holder of FIGS. 9-12 is configured to hold two electronic tags, indicated at 110 and 112. Electronic tag 110 features a connector 114 that engages PCB socket 66, while electronic tag 112 is connected to power terminals 68*a* and 68*b* via connection wires 116*a* and 116*b* (best shown in FIG. 12) and screws 118. Electronic tag 112 also engages and is supported in cradles 78*a* and 78*b* of the base plate 62.

As examples only, suitable tags include as functionality proximity, location and communication (both verbal and non-verbal) and may be obtained, for example, from Aeroscout of Redwood City, Calif. (such as the model Tag-3100), Becker Wholesale Mine Supply, L.L.C. of North Huntingdon, Pa. (such as the model TCTO 200ZA) and Newtrax Technologies Inc. of Montreal, Canada (such as the model Wn-202-02).

Figure 15:
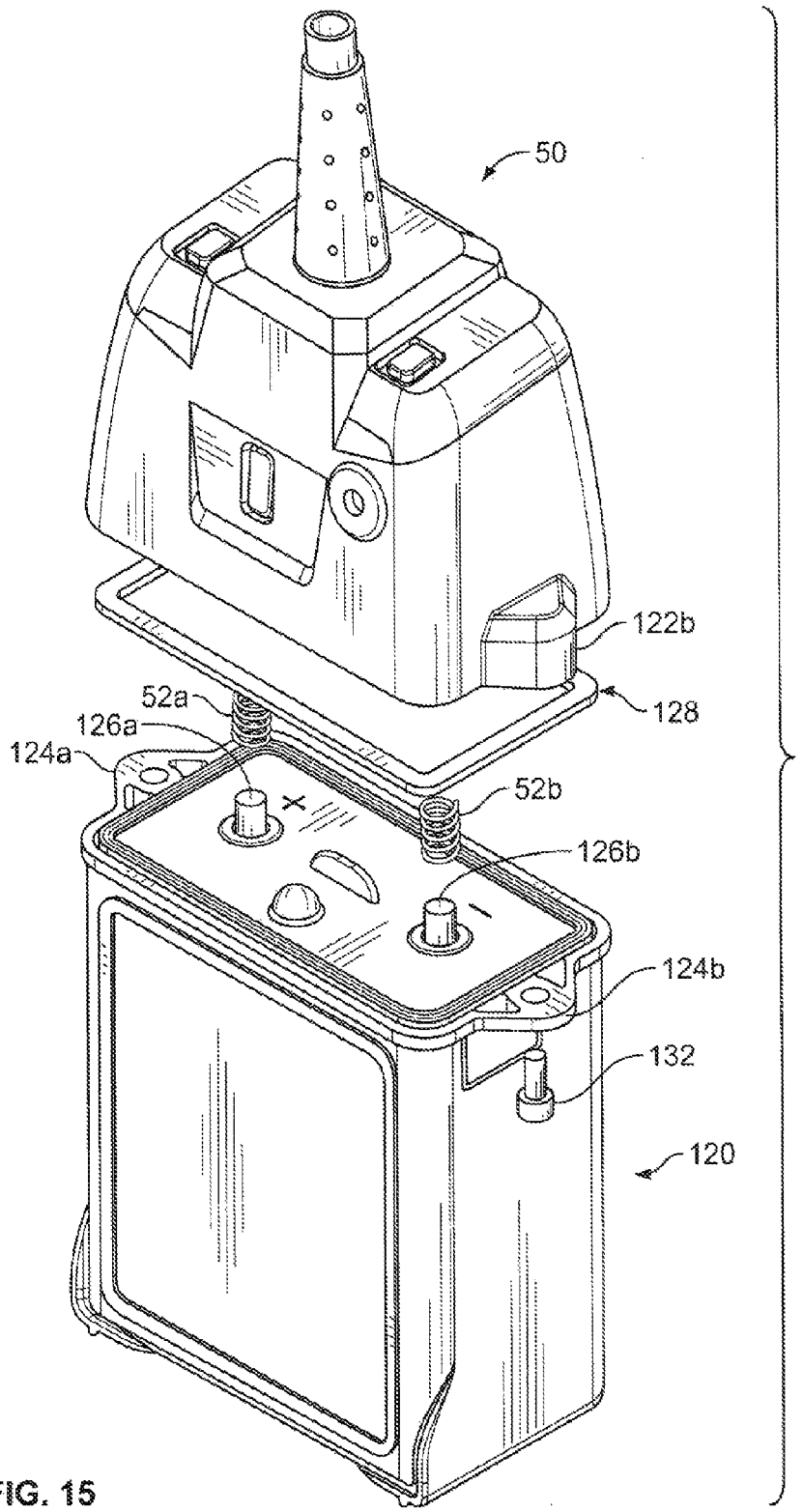
FIG. 15 is top perspective view of the multiple electronic tag holder of FIG. 14 and a battery pack.
Figure 16:
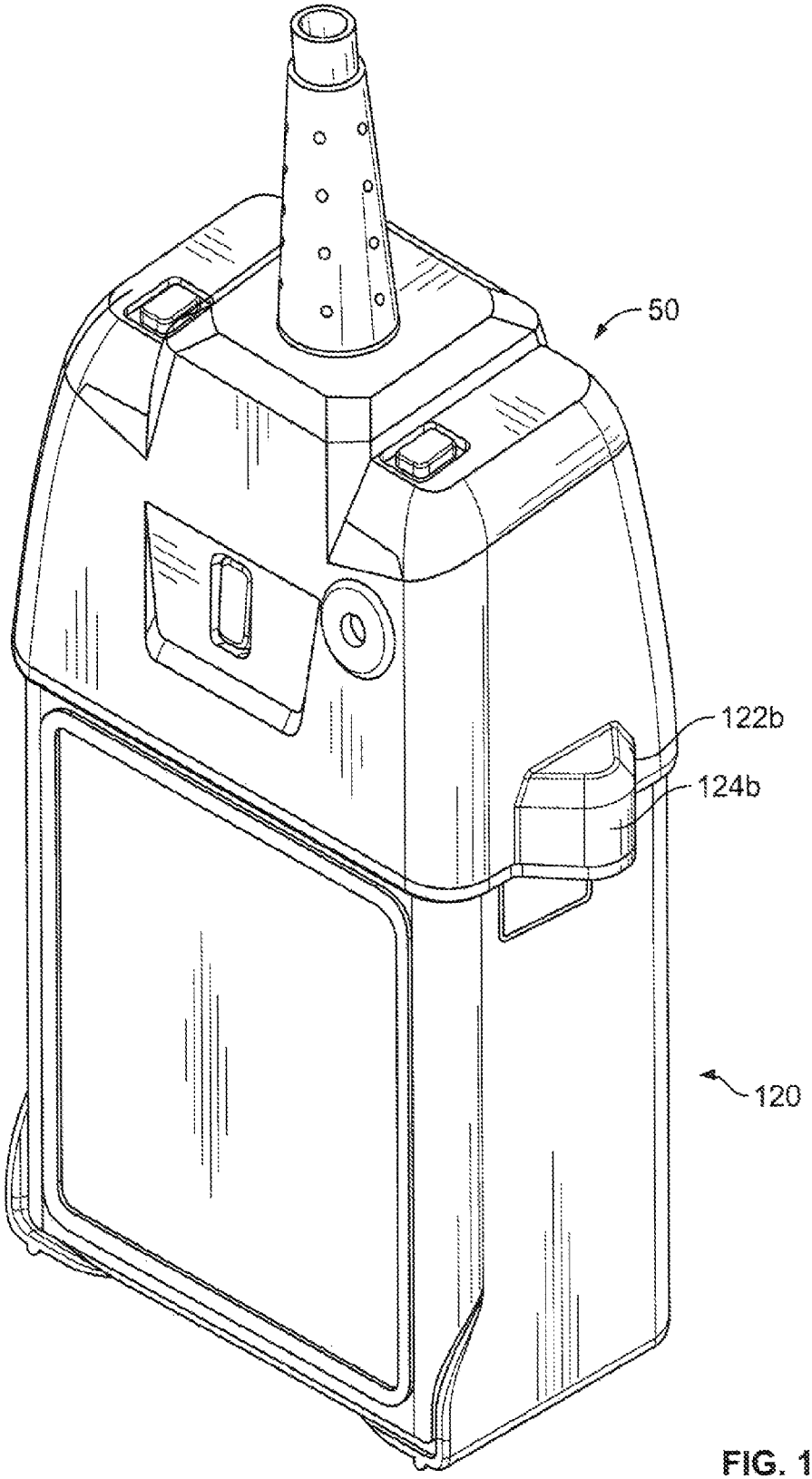
FIG. 16 is a top perspective view of the multiple electronic tag holder and battery pack of FIG. 15 in an assembled configuration.

Attachment of the tag holder 50 to a battery pack 120 is illustrated in FIGS. 14-16. As an example only, battery pack 120 may be a lithium-ion WHEAT LI battery pack available from Koehler-Bright Star LLC of Hanover Township, Pa. As illustrated in FIG. 14, the cover 82 of the tag holder 50 features tabs 122*a* and 122*b*. As shown in FIGS. 15 and 16, the battery pack features corresponding tabs 124*a* and 124*b*.

With reference to FIG. 15, contact springs 52*a* and 52*b* are positioned over the posts 126*a* and 126*b* of the battery pack. A lower gasket 128 is positioned on top of the battery pack and the tag holder 50 is then positioned above the battery pack and lowered into the position illustrated in FIG. 16. As illustrated in FIG. 14, and described previously, the base plate 62 of the tag holder is provided with conductive inserts 76*a* and 76*b* positioned within the hollow extender columns 74*a* and 74*b*. When the tag holder 50 is assembled to the battery pack 120 (FIG. 16), contact springs 52*a* and 52*b* enter the bottom openings of the hollow extender columns 74*a* and 74*b* and engage the conductive inserts 76*a* and 76*b*. As a result, current from the battery pack posts 126*a* and 1261 (FIG. 15) flows through the contact springs 52*a* and 52*b* and into terminal extenders 72*a* and 72*b* and the PCB 64 so that, with reference to FIG. 9, the tags 110 and 112 and cap lamp 54 are powered. The contact springs 52*a* and 52*b* permit variations in battery pack post height to be accommodated. In addition, this allows the tag holder internal circuitry to be protected from ingress of dust and liquid materials even when the tag holder is not connected to a battery pack.

Machine screws, indicated at 132 in FIGS. 9 and 15, engage suitable openings in the aligned tabs 124*a* and 124*b* of the battery pack and tabs 122*a* and 122*b* of the battery tag cover so that the tag holder 50 is secured on top of the battery pack 120. The lower gasket 128 prevents entry of contaminants such as dust and moisture between the attached tag holder and battery pack.

The battery pack 120 may optionally include a cap lamp circuit board to provide an optical warning of a low battery (such as by flashing and/or dimming the cap lamp), and/or other functionality. An example of such a cap lamp circuit board is provided in, commonly owned U.S. patent application Ser. No. 12/008,790, the contents of which are hereby incorporated by reference.

With reference to FIG. 9, the PCB 64 regulates and controls the power provided by the battery so that each electronic tag 110 and 112 receives power at the individually required voltage and current levels. A schematic of an embodiment of the PCB 64 is provided in FIG. 17. The PCB 64 features a positive terminal extender 72*a* and a negative terminal extender 72*b* that, as described above, are connected to the battery or the corresponding terminals of a battery pack. Lines 142*a* and 142*b* are connected to the PCB socket 66 and the positive and negative terminal extenders, respectively. Line 142*b* is provided with resistor 144 and fuse 146 so that the correct current is provided to the socket 66 to power the electronic tag plugged into the socket and for safety purposes. Lines 152*a* and 152*b* similarly are connected to the tag positive and negative terminals 68*a* and 68*b* and the positive and negative terminal extenders, respectively. Line 152*b* is provided with resistor 154 and fuse 156 so that the correct current is provided to the tag terminals 68*a* and 68*b* to power the electronic tag attached thereto and for safety purposes.

Figure 17:
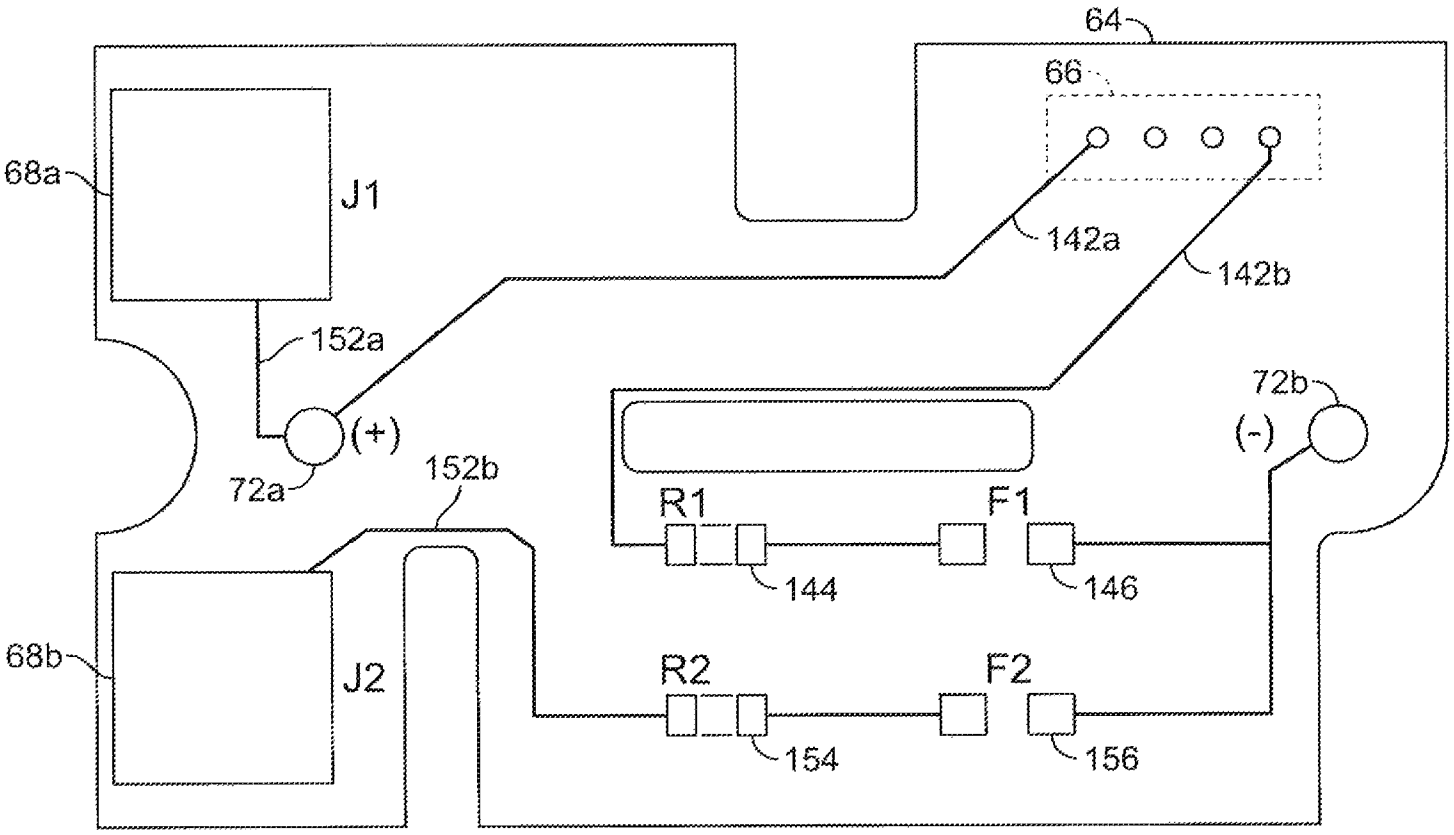
FIG. 17 is a schematic of an embodiment of the printed circuit board of the multiple electronic tag holder of FIGS. 9-12.

The PCB of FIG. 17 is a basic board for providing, power to electronic tags, such as tags 110 and 112 of FIGS. 9-12, and the design may change based on required functionality and the number and types of tags attached. For example, the PCB can provide one or multiple functions such as distributing power, limiting power, short circuit protection, send and receive signals for warnings or other communications (including verbal or non-verbal, with the latter including blinking light, warning light, buzzer etc.).

Figure 18:
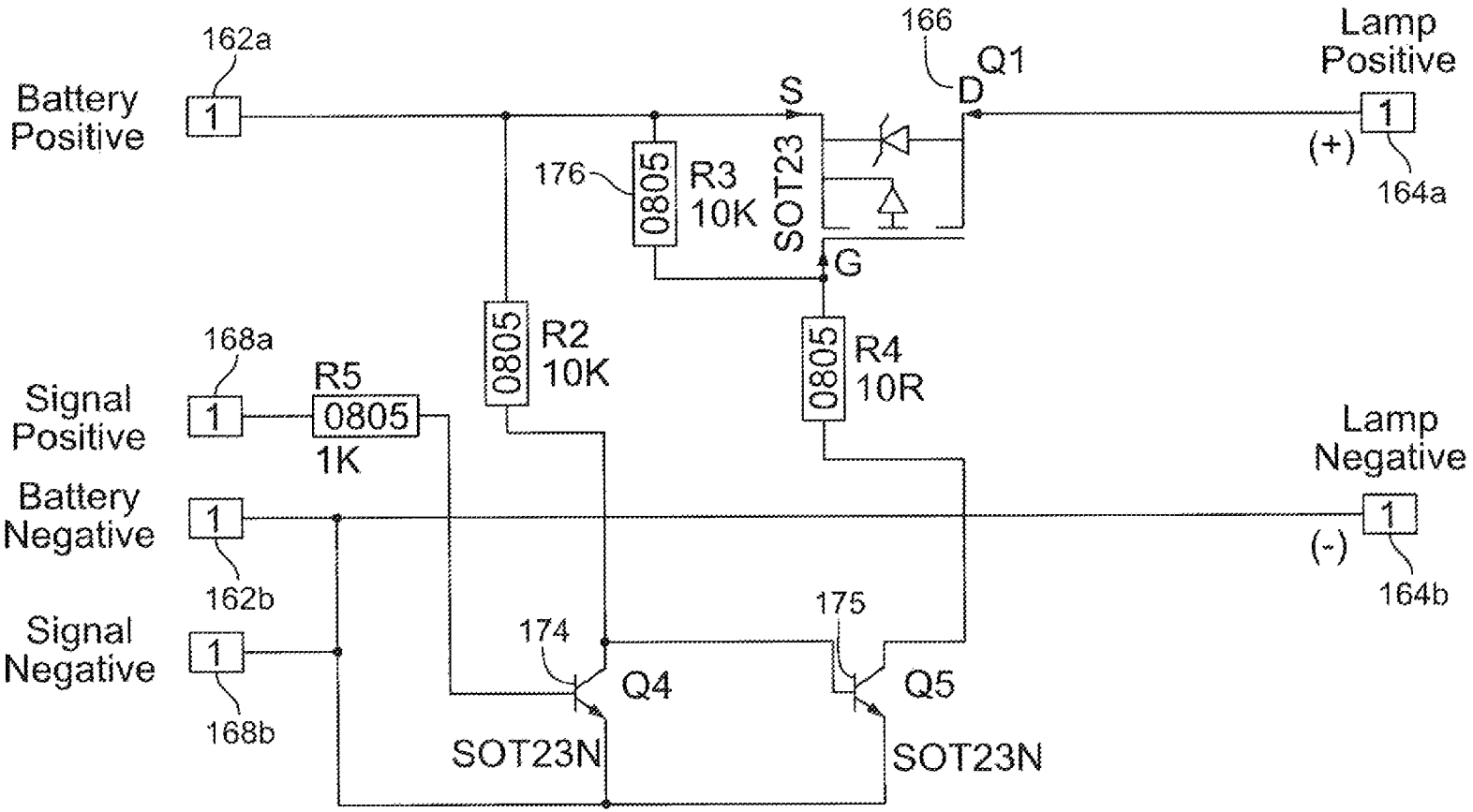
FIG. 18 is a schematic of an alternative embodiment of the printed circuit board of the multiple electronic tag holder of FIGS. 9-12.

An example of an alternative embodiment of or circuitry that may be added to, the PCB is provided in FIG. 18. The interrupt circuitry of FIG. 18 flashes the cap lamp as a warning indicator under the direction of a tag having, for example, a gas or dust sensor or where the tag is a communications device and an emergency evacuation signal is received. More specifically, with reference to FIG. 18, terminals 162*a* and 162*b* receive power from a battery or battery pack to which the tag holder is connected to. The cap lamp is connected to the circuitry via terminals 164*a* and 164*b*. A transistor 166 (a P-ch MOSFET) conducts from source to drain during normal operation of the tag interrupt PCB so that the cap lamp is ON.

An electronic tag is attached to the interrupt PCB of FIG. 18 at terminals 168*a* and 168*b*. When the tag receives a wireless signal with an emergency communication, or senses a hazardous condition, a positive pulse width signal is sent to the tag interrupt PCB via terminals 168*a* and 168*b*. The positive pulsed signal is applied to the base of a transistor 174, allowing it to turn on and pull the base of transistor 175 to LOW, thus turning it off Once the base of transistor 175 is LOW, the transistor is open from collector to emitter, and the gate of MOSFET 166 rises to the same level as the source of MOSFET 166, due to resistor 176.

Once the gate voltage of 166 rises above the gate threshold of the device, the device turns off, current is no longer flowing, and the cap lamp LED is off. When the positive signal from the electronic tag connected to terminals 168*a* and 168*b* is removed (i.e. is no longer positive), the gate of MOSFET 166 goes low and the transistor returns to a conducting mode, and the cap lamp is ON.

With reference to FIG. 19, while two tags are shown for the multiple electronic tag holder 50 of FIGS. 9-16, the PCB may be configured to provide power to three or more tags. In addition, the circuit board 64 may be omitted and the power from the battery pack 120 provided to the tags 110, 112 and 182 by alternative circuitry contained within the tag holder 50 as indicated in phantom at 183). In addition, the tag holder 50 may include buttons connected to the circuit board (184) and/or one or more of the nuts (186) for emergency functions such as calling for help or an emergency-stop button that sends signal via tags to a system to stop approaching vehicle to avoid crushing injuries.

Figure 20:
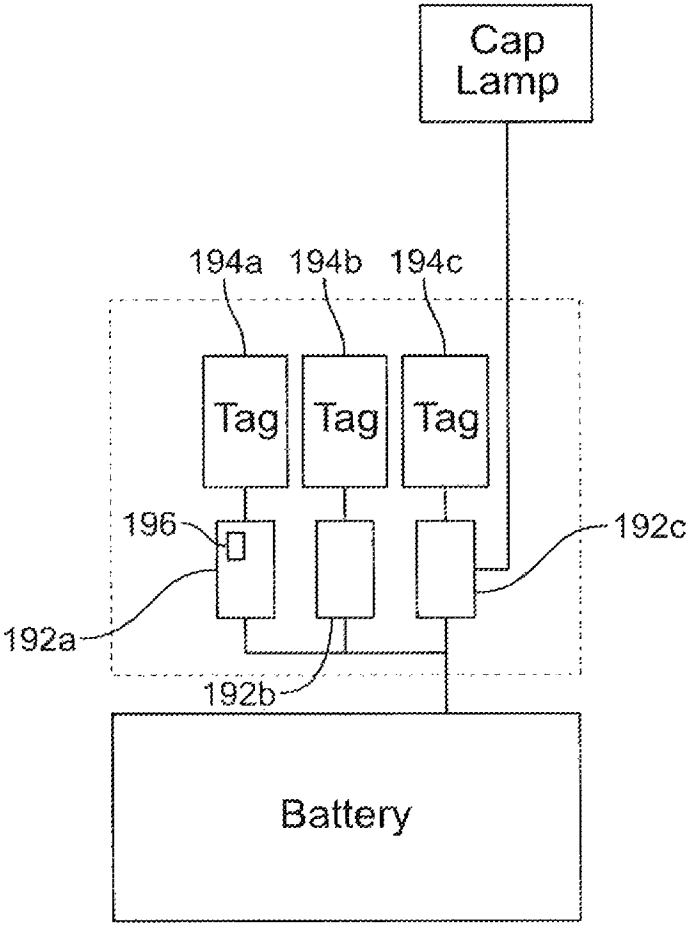
FIG. 20 is a schematic of a second embodiment of the multiple electronic tag holder of the present invention and a battery pack.

A second embodiment of the multiple electronic tag holder is illustrated in FIG. 20, where multiple tag circuit boards 192*a*, 192*b* and 192*c* replace the single tag circuit board 64 of FIG. 19. Each one of the tag circuit boards may be specially configured to power and enable operation of corresponding tags 194*a*, 194*b* and 194*c*.

With reference to FIG. 20, a PCB 192*a* may be configured with a motion sensor 196 and attached to a communications electronic tag 194*a* so that if the worker does not move for a predetermined period of time, help requested via the communications tag. The PCB may alternatively also feature communications components. The motion sensor could take the form of an inertia sensor, an infrared light device (such as the Panasonic EKMC) or an accelerometer (such as the Panasonic GS1).

Figure 21:
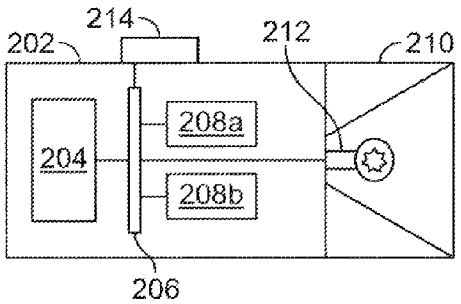
FIG. 21 is a schematic of a third embodiment of the multiple electronic tag holder of the present invention.

In a third embodiment of the multiple electronic tag holder, illustrated in FIG. 21, the battery pack takes the form of a cordless cap lamp, where housing 202 contains not only the battery 204, (optional) tag circuit board 206 and tag devices 208*a* and 208*b*, but also the cap lamp itself 210, including light source 212 which may be, as an example only, and LED bulb. As switch 214 is also provided to energize the cap lamp.

Figure 22:
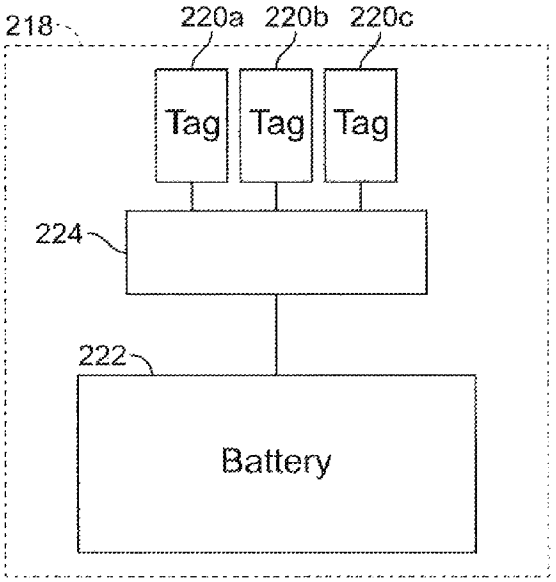
FIG. 22 is a schematic of a fourth embodiment of the multiple electronic tag holder of the present invention.

A fourth embodiment of the multiple electronic tag holder, illustrated in FIG. 22, is similar to the embodiment of FIG. 19, but omits the cap lamp and the battery 222 is also placed in the housing 218. As a result, it is a device that may be carried by the user where multiple tag devices 220*a*-220*c* are powered by a single battery 222 through tag circuit board 224. Of course the battery may be positioned external to the housing 218 as either a battery pack or battery.

Figure 23:
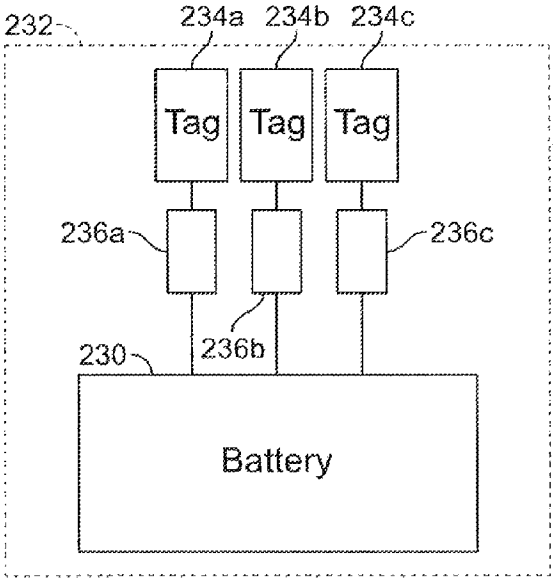
FIG. 23 is a schematic of a fifth embodiment of the multiple electronic tag holder of the present invention.

A fifth embodiment of the multiple electronic tag holder, illustrated in FIG. 23, is similar to the embodiment of FIG. 20, but omits the cap lamp and the battery 230 is also positioned within the housing 232. As a result, it is a device that may be carried by the user where multiple tag devices 234*a*-234*c* are powered by a single battery 230 through multiple tag circuit boards 236*a*-236*c*.

Figure 24:
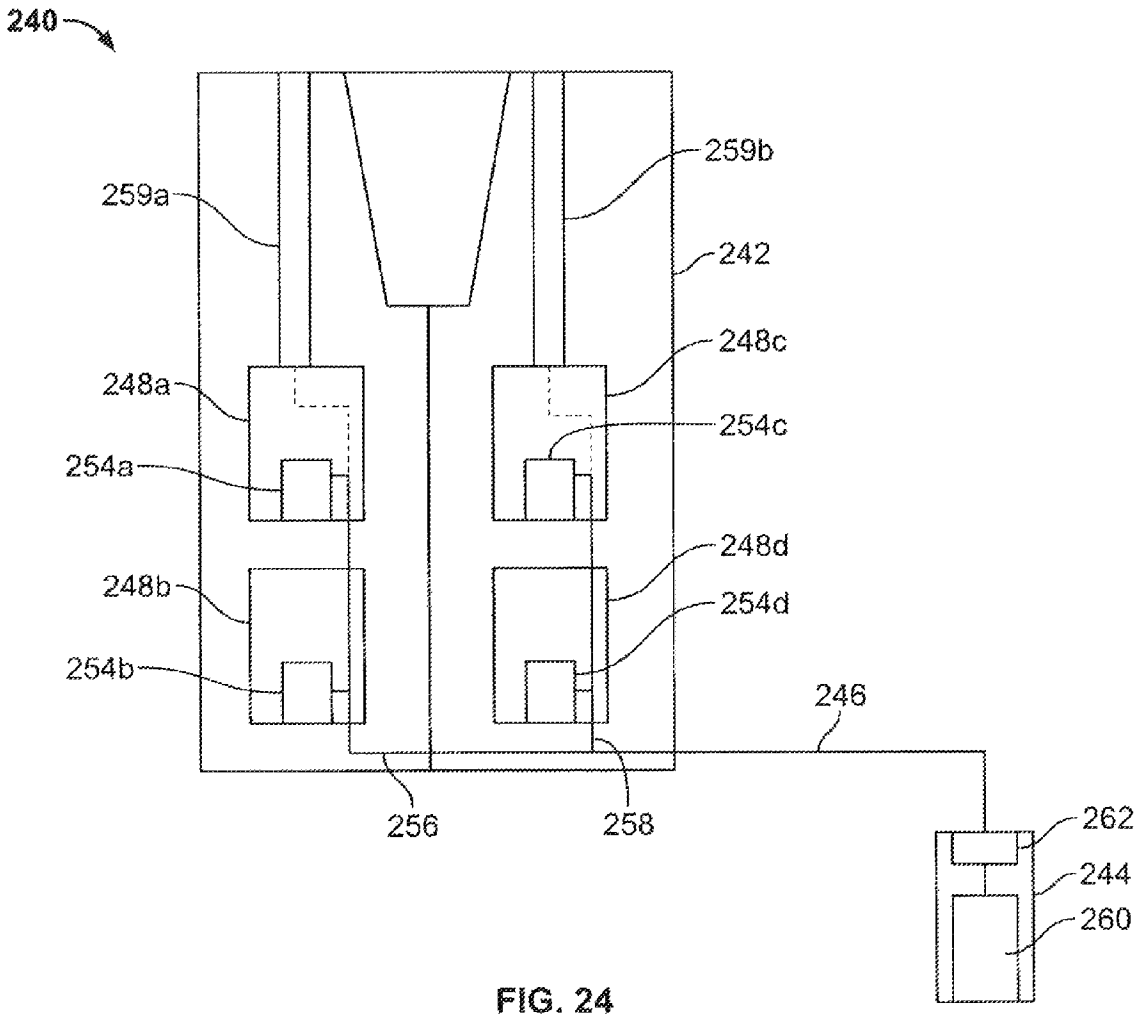
FIG. 24 is a schematic of an embodiment of the multiple electronic tag holder of the present invention as used with a vest.

A system using an embodiment of the invention is indicated in general at 240 in FIG. 24 and includes a vest 242 that features electronic tags that are powered via a battery pack 244 and power cord 246. As illustrated in FIG. 24, the vest 242 features pockets 248*a*-248*d* within which electronic tags 254*a*-254*d* are positioned. Tag devices 254*a* and 254*b* are powered by branch 256 of the power cord 246 while tag devices 254*c* and 254*d* are powered by branch 258 of the power cord. As a result, branches 256 and 258 and power cord 246 form a power manifold for powering the tag devices via the battery pack 244. In addition, or alternatively, the branches 256 and 258 may be used to power suspenders 259*a* and 259*b* or other vest illuminated features constructed from ribbon tape optical fiber, or other illuminating material, to make the worker more visible to avoid collisions with machines or vehicles where ambient lighting is minimal (such as in a mine).

As illustrated in FIG. 24, the battery pack 244 contains a battery 260 and an (optional) tag circuit board 262. Alternatively, the system may include multiple tag circuit boards with a tag circuit board positioned in each pocket of the vest along with the corresponding tag device. The battery 260 may be any type of battery known in the prior art, but is preferably a lithium-ion battery.

The electronic tags in the embodiments described above can include any combination of any tag devices known in the art, with the corresponding tag circuit board(s) adapted to provide the correct lower requirements and functions (if used) from the single battery. The electronic tags may be individually removed from the multiple electronic tag holders and replaced with other types of electronic tags (as long as there is compatibility with the PCB), which provides the multiple electronic tag holder of the invention with great flexibility and facilitates updating/upgrading with updated/upgraded electronic tags.

As noted previously, examples of some tag devices that can be incorporated into the battery pack of the invention include, but are not limited to, tracking and proximity tag devices, which are both used to track personnel and equipment in various locations such as mines, large jobsites, and hazardous areas for the satiety of each individual, gas sensor tags and various tag devices incorporating technologies that are used to track individuals that are in hazardous locations and require each individual to wear some sort of monitoring device. These technologies include, or work with various technologies, but are not limited to, the following:

(a) Leaky Feeder Systems
(b) Mesh Systems
(c) Medium Frequency Radio Systems
(d) Radio Frequency Identification (RFID)
(e) Inertial Navigation
(f) Through the Earth The embodiments of the present invention described above thus offer several advantages. They provide integration of multiple electronic tags with a cap lamp and power source which allows for more available power to the tags. This can be critical in an emergency situation where longer run time is needed. In addition, they each provide one singular, integrated system that allows the user to minimize the number of individual devices that need to be carried and keep all tags in a uniform, compact housing. They limit battery maintenance to one device, and increase overall ease of use.

While the preferred embodiments of the invention have been shown and described, it will be apparent to those skilled in the art that changes and modifications may be made therein without departing from the spirit of the invention, the scope of which is defined by the appended claims.

What is claimed is:

1. A multiple electronic tag holder comprising:

a) a housing adapted to hold a plurality of electronic tags;

b) circuitry adapted to electrically engage a battery and the plurality of electronic tags so that the plurality of electronic tags are powered by the battery, said circuitry positioned within the housing, the housing including a base plate and the circuitry including a printed circuit board mounted on the base plate, said printed circuit board adapted to receive the plurality of electronic tags, said base plate including a pair of hollow terminal extension columns with a pair of terminal extensions extending there through, where the terminal extensions are in communication with the print circuit board, and a pair of conductive inserts positioned within hollow terminal columns and further comprising a pair of contact springs that are adapted to engage posts of a battery and be received within the conductive inserts of the base plate.

2. The multiple electronic tag holder of claim 1 wherein the housing includes a base plate adapted to hold the plurality of electronic tags and a cover removably attached to the base plate.

3. The multiple electronic tag holder of claim 2 further comprising an upper gasket positioned between the cover and the base plate.

4. The multiple electronic tag holder of claim 2 wherein the circuitry includes a printed circuit board mounted on the base plate, said printed circuit board adapted to receive power from the battery and power the plurality of electronic tags.

5. The multiple electronic tag holder of claim 4 wherein the printed circuit board includes a socket adapted to attach to one of the plurality of electronic tags.

6. The multiple electronic tag holder of claim 4 wherein the printed circuit board includes a pair of tag power terminals adapted to power one of the plurality of electronic tags.

7. The multiple electronic tag holder of claim 1 wherein the circuitry includes a printed circuit board adapted to receive power from the battery and power the plurality of electronic tags.

8. The multiple electronic tag holder of claim 7 wherein the printed circuit board includes a socket adapted to attach to one of the plurality of electronic tags.

9. The multiple electronic tag holder of claim 7 wherein the printed circuit board includes a pair of tag power terminals adapted to power one of the plurality of electronic tags.

10. The multiple electronic tag holder of claim 7 wherein the printed circuit board includes circuitry to blink a cap lamp when provided with a signal from one of the plurality of electronic tags.

11. The multiple electronic tag holder of claim 7 wherein the printed circuit board includes a motion sensor adapted to signal one of the plurality of electronic tags when a user is not moving.

12. The multiple electronic tag holder of claim 1 further comprising a battery positioned within the housing and in engagement with the circuitry.

13. The multiple electronic tag holder of claim 12 further comprising a light source in communication with the battery.

14. The multiple electronic tag holder of claim 13 wherein the light source is also positioned within the housing.

15. The multiple electronic tag holder of claim 1 further comprising a plurality of printed circuit boards, each adapted to communicate with one of the plurality of electronic tags.

16. The multiple electronic tag holder of claim 1 further comprising a lower gasket positioned on a bottom of the housing.

17. A cap lamp system comprising:

a) a battery pack having a battery pack housing;

b) a multiple electronic tag holder including:

i. a tag holder housing holding a plurality of electronic tags;

ii. circuitry electrically engaging the battery and the plurality of electronic tags so that the plurality of electronic tags are powered by the battery, said circuitry positioned within the tag holder housing;

c) the tag housing attached to the battery pack housing; and d) a cap lamp attached to the circuitry of the multiple electronic tag holder to receive power from the battery, wherein the housing includes a base plate and the circuitry includes a printed circuit board mounted on the base plate, said circuit board adapted to receive the plurality of electronic tags, said base plate including a pair of hollow terminal extension columns with a pair of terminal extensions extending there through, where the terminal extensions are in communication with the printed circuit board, and a pair of conductive inserts positioned within hollow terminal columns, and further comprising a pair of contact springs that are adapted to engage posts of a battery and be received within the conductive inserts of the base plate.

18. The cap lamp system of claim 17 wherein the tag holder housing includes a base plate holding the plurality of electronic tags and a cover removably attached to the base plate.

19. The cap lamp system of claim 18 wherein the circuitry includes a printed circuit board mounted on the base plate, said printed circuit board receiving power from the battery and powering the plurality of electronic tags.

20. The cap lamp system of claim 17 wherein the circuitry includes a printed circuit board adapted to receive power from the battery and power the plurality of electronic tags.

21. The cap lamp system or claim 20 wherein the printed circuit board includes circuitry to blink the cap lamp when provided with a signal from one of the plurality of electronic tags.

22. The cap lamp system of claim 20 wherein the printed circuit board includes a motion sensor adapted to signal one of the plurality of electronic tags when a user is not moving.

23. The cap lamp system of claim 17 further comprising a plurality of printed circuit boards positioned within the tag holder housing, each adapted to communicate with one of the plurality of electronic tags.

* * * * *